US011079079B2

(12) United States Patent
Lim et al.

(10) Patent No.: US 11,079,079 B2
(45) Date of Patent: Aug. 3, 2021

(54) TROFFER LIGHT FIXTURE

(71) Applicant: IDEAL Industries Lighting LLC, Racine, WI (US)

(72) Inventors: Jin Hong Lim, Morrisville, NC (US); Mark Boomgaarden, Cary, NC (US); Randall Levy Bernard, Durham, NC (US); Kurt Wilcox, Libertyville, IL (US); Curt Progl, Raleigh, NC (US)

(73) Assignee: Ideal Industries Lighting, LLC, Sycamore, IL (US)

( * ) Notice: Subject to any disclaimer, the term of this patent is extended or adjusted under 35 U.S.C. 154(b) by 0 days.

(21) Appl. No.: 16/937,026

(22) Filed: Jul. 23, 2020

(65) Prior Publication Data

US 2020/0408368 A1 Dec. 31, 2020

Related U.S. Application Data

(63) Continuation-in-part of application No. 16/692,130, filed on Nov. 22, 2019, now Pat. No. 10,794,572, which is a continuation of application No. 15/710,913, filed on Sep. 21, 2017, now Pat. No. 10,508,794.

(51) Int. Cl.

| | |
|---|---|
| ***F21S 8/02*** | (2006.01) |
| ***F21K 9/68*** | (2016.01) |
| ***F21V 13/04*** | (2006.01) |
| ***F21K 9/69*** | (2016.01) |
| *F21Y 103/10* | (2016.01) |
| *F21Y 115/10* | (2016.01) |

(52) U.S. Cl.
CPC ..... *F21S 8/026* (2013.01); *F21K 9/68* (2016.08); *F21K 9/69* (2016.08); *F21V 13/04* (2013.01); *F21Y 2103/10* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 5,384,693 | A | 1/1995 | Schwaller et al. |
| 7,874,697 | B2 | 1/2011 | Biebel et al. |
| 8,310,143 | B2 | 11/2012 | Van De Ven et al. |
| 8,736,186 | B2 | 5/2014 | Chobot |
| 8,829,821 | B2 | 9/2014 | Chobot et al. |
| 8,912,735 | B2 | 12/2014 | Chobot et al. |
| 8,975,827 | B2 | 3/2015 | Chobot et al. |
| 9,155,165 | B2 | 10/2015 | Chobot |
| 9,155,166 | B2 | 10/2015 | Chobot |
| 9,433,061 | B2 | 8/2016 | Chobot |

(Continued)

OTHER PUBLICATIONS

Natural Resources Canada, "Lighting for Health and Energy Savings", The Lighting Energy Alliance and Light and Health Alliance at the Lighting Research Center, Mar. 1, 2019, pp. 1-7, Rensselaer Polytechnic Institute.

(Continued)

*Primary Examiner* — Elmito Breval
(74) *Attorney, Agent, or Firm* — Withrow & Terranova, PLLC

(57) ABSTRACT

A light fixture with a troffer design. The light fixture includes a housing, LED assembly, and lens assembly. An inner lens can be positioned over the LED assembly to control the distribution of light. A reflector can be positioned over the LED assembly instead of the inner lens to control the light.

24 Claims, 18 Drawing Sheets

(56) References Cited

U.S. PATENT DOCUMENTS

| | | | |
|---|---|---|---|
| 9,572,226 | B2 | 2/2017 | Motley |
| 9,622,321 | B2 | 4/2017 | Creasman et al. |
| 9,786,639 | B2 | 10/2017 | Bergmann et al. |
| 9,900,957 | B2 | 2/2018 | Van De Ven et al. |
| 10,161,612 | B2 | 12/2018 | Chobot et al. |
| 10,203,088 | B2 | 2/2019 | Lay et al. |
| 10,247,372 | B2 | 4/2019 | Wilcox et al. |
| 10,278,250 | B2 | 4/2019 | McBryde et al. |
| 10,412,809 | B2 | 9/2019 | Van De Ven |
| 10,451,229 | B2 | 10/2019 | Keller et al. |
| 10,465,869 | B2 | 11/2019 | Keller et al. |
| 10,502,374 | B2 | 12/2019 | Leung et al. |
| 10,508,794 | B2 | 12/2019 | Lim et al. |
| 10,527,785 | B2 | 1/2020 | Tarsa et al. |
| 10,529,900 | B2 | 1/2020 | Zhang et al. |
| 2008/0278943 | A1 | 11/2008 | Van Der Poel |
| 2011/0222279 | A1 | 9/2011 | Kim et al. |
| 2012/0299017 | A1 | 11/2012 | Chen et al. |
| 2013/0258245 | A1 | 10/2013 | Fang |
| 2014/0268790 | A1 | 9/2014 | Chobot et al. |
| 2014/0347885 | A1 | 11/2014 | Wilcox et al. |
| 2016/0061413 | A1 | 3/2016 | Hedberg, Jr. |
| 2016/0305619 | A1 | 10/2016 | Howe |
| 2018/0172246 | A1 | 6/2018 | Walker et al. |
| 2020/0088387 | A1 | 3/2020 | Lim et al. |

OTHER PUBLICATIONS

U.S. Appl. No. 61/932,058, filed Jan. 27, 2014.

U.S. Appl. No. 62/292,528, filed Feb. 8, 2016.

Cree Lighting, "Cree Flex Series LED Spec-Grade Troffer Sales Sheet", Jan. 10, 2019, pp. 1-2, obtained from Internet: https://www.creelighting.com/Coveo_Rest/searchresults/indexall?searchCollection=%40syscollection%3DLighting&q=troffer#q=troffer&sort=relevancy.

Cree Lighting, "ZR Series Troffer Sales Sheet", Jun. 5, 2017, pp. 1-2, obtained from Internet: https://www.creelighting.com/Coveo_Rest/searchresults/indexall?searchCollection=%40syscollection%3DLighting&q=troffer#q=troffer&sort=relevancy.

Cree Lighting, "Flex Series Spec-Grade Troffer sales sheet", Jan. 10, 2019, pp. 1-4, obtained from Internet: https://www.creelighting.com/Coveo_Rest/searchresults/indexall?searchCollection=%40syscollection%3DLighting&q=troffer#q=troffer&sort=relevancy.

Cree Lighting, "C-Lite® C-TR-A-BT24 Series LED Basket Troffer 2'×4' Spec Sheet", Jun. 8, 2020, pp. 1-3, obtained from Internet: https://www.creelighting.com/Coveo_Rest/searchresults/indexall?searchCollection=%40syscollection%3DLighting&q=troffer#q=troffer&sort=relevancy.

Cree Lighting, "Surface Mount Kit Installation Instructions for CR Troffers", Jan. 10, 2020, pp. 1-2, obtained from Internet: https://www.creelighting.com/Coveo_Rest/searchresults/indexall?searchCollection=%40syscollection%3DLighting&q=troffer#q=troffer&sort=relevancy.

| CCX | CCY |
|---|---|
| 0.29 | 0.32 |
| 0.35 | 0.38 |
| 0.40 | 0.42 |
| 0.48 | 0.44 |
| 0.48 | 0.39 |
| 0.40 | 0.36 |
| 0.32 | 0.30 |
| 0.29 | 0.32 |

Max/Min = 3.3

Max/Min = 5.3

Max/Min = 4.5

Max/Min = 3.2

Max/Min = 3.3

Max/Min = 4.6

TROFFER LIGHT FIXTURE

The present application is a continuation-in-part of U.S. patent application Ser. No. 16/692,130 filed on Nov. 22, 2019 and which has since issued as U.S. Pat. No. 10,794,572, which is a continuation of U.S. patent application Ser. No. 15/710,913 filed on Sep. 21, 2017 and which has since issued as U.S. Pat. No. 10,508,794.

FIELD OF THE INVENTION

The invention relates to light fixtures and, more particularly, to troffer light fixtures that are well-suited for use with solid state lighting sources, such as light emitting diodes (LEDs).

BACKGROUND

Troffer light fixtures are ubiquitous in residential, commercial, office and industrial spaces throughout the world. In many instances these troffer light fixtures house elongated fluorescent light bulbs that span the length. Troffer light fixtures can be used in a wide variety of manners, including but not limited to being mounted to or suspended from ceilings, and recessed into the ceiling with the back side protruding into the plenum area above the ceiling. Elements on the back side of the troffer light fixture may dissipate heat generated by the light source into the plenum where air can be circulated to facilitate the cooling mechanism.

More recently, with the advent of efficient solid state lighting sources, these troffer light fixtures have been used with LEDs. LEDs have certain characteristics that make them desirable for many lighting applications that were previously the realm of incandescent or fluorescent lights. LEDs can emit the same luminous flux as incandescent and fluorescent lights using a fraction of the energy. In addition, LEDs can have a significantly longer operational lifetime.

BRIEF SUMMARY

Embodiments of the present disclosure generally relate to luminaires configured to emit light. The luminaires include one or more light adaptation modules that can be mounted to adjust a color temperature of the emitted light In particular, one or more aspects include a light fixture comprising a housing comprising a back pan. The housing comprises a centerline that bisects the housing into first and second lateral sections. LED elements are aligned in a linear array along the back pan. A lens assembly extends over the LED assembly with the lens assembly comprising a first fixture lens and a second fixture lens that are connected together along the centerline. An inner lens extends over the LED elements and is positioned on the centerline. The inner lens comprises a cavity that faces towards the LED elements and an outer surface that faces towards the lens assembly. The inner lens is configured to direct light emitted from the LED assembly away from a center zone that is centered on the centerline and direct the light into first and second light zones positioned on each lateral side of the center zone and that extend between the center zone and the back pan.

In another aspect, the inner lens symmetrically divides the light equally with a first half of the light emitted into the first light zone and a second half of the light emitted into the second light zone.

In another aspect, the inner lens distributes the light smoothly from the outer surface without interaction.

In another aspect, the outer surface of the inner lens comprises a dimple that is aligned with the centerline with the outer surface further comprising a first section that extends between the dimple and a first lateral end and a second section that extends between the dimple and a second lateral end and with each of the first and second sections comprising equal shapes and sizes.

In another aspect, the cavity comprises a peak that is aligned with the centerline and a shape that is symmetrical about the centerline.

In another aspect, the inner lens comprises a dimple on the outer surface and a peak on an inner surface of the cavity with each of the dimple and the peak positioned on the centerline and with the inner lens comprising symmetrical first and second sections on opposing sides of a line that extends through the peak and the dimple.

In another aspect, the inner lens comprises a thickness measured between the cavity and the outer surface with the inner lens having a minimum thickness at a midpoint of a width measured between opposing lateral ends.

In another aspect, the light fixture comprises a lens uniformity of between about 1.5 and 2.0 in a front view.

In another aspect, an enclosed interior space is formed between the lens assembly and the back pan with the LED elements and the inner lens positioned in the interior space.

In another aspect, the lens assembly comprises a connector that connects together the first and second fixture lenses with the connector comprising a body with a first slot that receives an edge of the first fixture lens and a second slot that receives an edge of the second fixture lens and with the connector aligned on the centerline.

In another aspect, the back pan comprises a concave shape with a center section that supports the LED assembly and a pair of wings that extends outward from the center section with the back pan having a symmetrical shape about the centerline that extends through the center section.

In another aspect, the light fixture comprises a lens uniformity between about 2.0 and 4.0 in a front view.

One aspect is directed to a light fixture comprising a direct troffer unit comprising a longitudinal axis and a centerline that divides that direct troffer unit along the longitudinal axis into first and second lateral sections. The direct troffer unit comprises: a back pan; LED elements aligned in a linear array along the back pan; and a lens assembly that extends over the LED assembly. An inner lens is positioned between the LED elements and the lens assembly with the inner lens comprising: a first surface that faces towards the LED elements and having a cavity that extends over the LED elements and comprises a peak that is positioned on the centerline; and an outer surface that faces towards the lens assembly and comprises a dimple that is positioned on the centerline.

In another aspect, the inner lens is symmetrical about a straight line that extends through both the peak and the dimple.

In another aspect, the outer surface comprises a first section that extends between a first lateral end and the dimple and a second section that extends between a second lateral end and the dimple with the first and second sections comprising equal shapes and sizes.

In another aspect, the cavity comprises a symmetrical shape about a straight line that extends through both the peak and the dimple.

In another aspect, the inner lens is configured to distribute light rays from the LED assembly smoothly without interaction.

In another aspect, the inner lens is a negative lens that diverges light from the LED assembly outward away from the centerline.

In another aspect, the inner lens is configured to divert light away from a center zone that is centered along the centerline and to direct light into first and second light zones positioned on lateral sides of the center zone.

One aspect is directed to a light fixture comprising a housing with a back pan with the housing comprising a centerline that bisects the housing into first and second lateral sections. LED elements are aligned in a linear array along the back pan. A lens assembly extends over the LED elements with the lens assembly comprising a first fixture lens and a second fixture lens that are connected together along the centerline. A reflector extends between the LED elements and the lens assembly with the reflector comprising a symmetrical shape that is centered on the centerline and comprising a central specular section centered on the centerline and outer diffuse sections on each lateral side of the specular section.

In another aspect, the reflector comprises a folded configuration with a fold line that is located along a center of the specular section and with the fold line being collinear with the centerline.

In another aspect, the reflector comprises partially diffuse reflection around the boundary of the central specular reflection section and the outer diffuse reflection section.

Of course, those skilled in the art will appreciate that the present embodiments are not limited to the above contexts or examples, and will recognize additional features and advantages upon reading the following detailed description and upon viewing the accompanying drawings.

BRIEF DESCRIPTION OF THE DRAWINGS

FIG. 30B illustrates luminous flux distribution patterns for a light fixture with a sixth inner lens as in FIG. 31.

DETAILED DESCRIPTION

Figure 1:
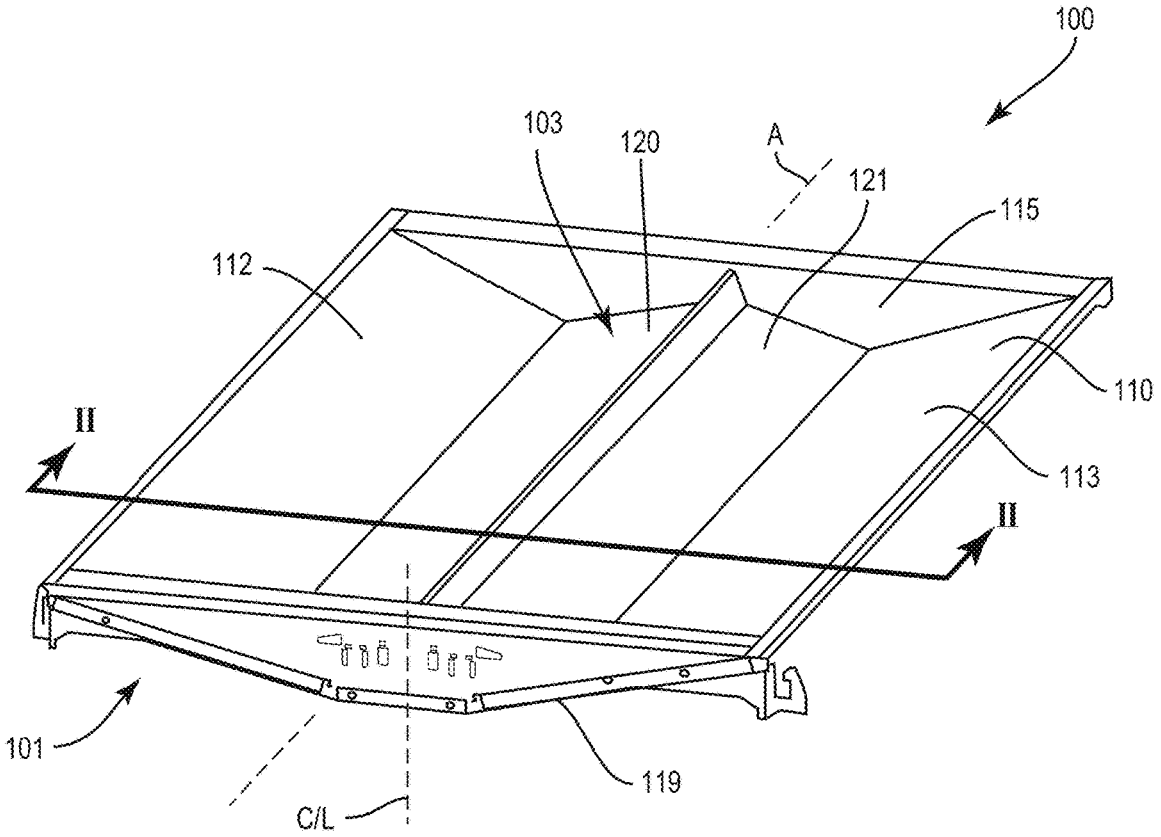
FIG. 1 is a perspective view of a light fixture.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The expression "correlated color temperature" ("CCT") is used according to its well-known meaning to refer to the temperature of a blackbody that is nearest in color, in a well-defined sense (i.e., can be readily and precisely determined by those skilled in the art). Persons of skill in the art are familiar with correlated color temperatures, and with Chromaticity diagrams that show color points to correspond to specific correlated color temperatures and areas on the diagrams that correspond to specific ranges of correlated color temperatures. Light can be referred to as having a correlated color temperature even if the color point of the light is on the blackbody locus (i.e., its correlated color temperature would be equal to its color temperature); that is, reference herein to light as having a correlated color temperature does not exclude light having a color point on the blackbody locus.

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 2:
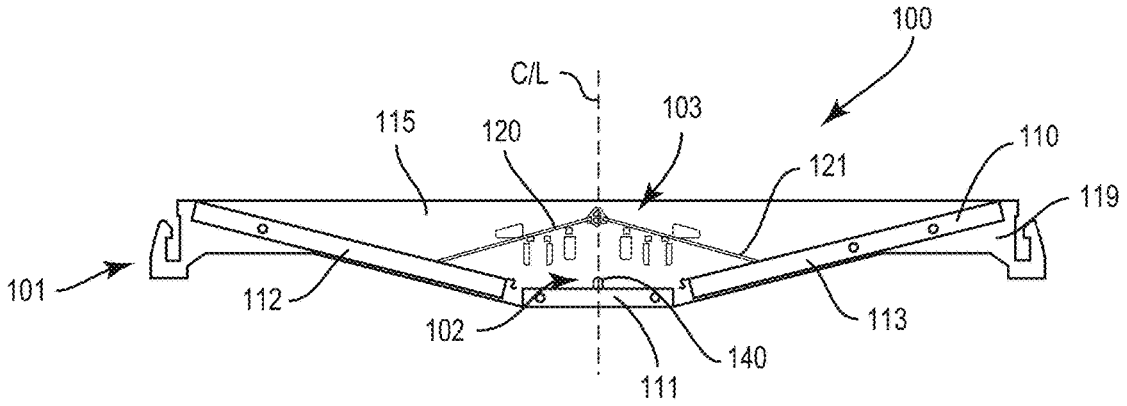
FIG. 2 is a schematic section view cut along line II-II of FIG. 1.

FIGS. 1 and 2 illustrate a troffer light fixture 100 (hereinafter light fixture). The light fixture 100 generally includes a housing 101, an LED assembly 102, a lens assembly 103, and an inner lens 140.

The housing 101 extends around the exterior of the light fixture 100 and is configured to mount or otherwise be attached to a support. The light fixture 100 includes a longitudinal axis A that extends along the length. A width is measured perpendicular to the longitudinal axis A. As illustrated in FIG. 2, when viewed from the end, a centerline C/L extends through the light fixture 100 and divides the light fixture 100 into first and second lateral sections. The light fixture 100 can have a variety of different sizes, including standard troffer fixture sizes, such as but not limited to 2 feet by 4 feet (2'×4'), 1 foot by 4 feet (1'×4'), or 2 feet by 2 feet (2'×2'). However, it is understood that the elements of the light fixture 100 may have different dimensions and can be customized to fit most any desired fixture dimension.

FIG. 1 illustrates the light fixture 100 in an inverted configuration. In some examples, the light fixture 100 is mounted on a ceiling or other elevated position to direct light vertically downward onto the target area. The light fixture 100 may be mounted within a T grid by being placed on the supports of the T grid. In other examples, additional attachments, such as tethers, may be included to stabilize the fixture in case of earthquakes or other disturbances. In other embodiments, the light fixture 100 may be suspended by cables, recessed into a ceiling or mounted on another support structure.

The housing 101 includes a back pan 110 with end caps 115 secured at each end. The back pan 110 and end caps 115 form a recessed pan style troffer housing defining an interior space for receiving the LED assembly 102. In one example, the back pan 110 includes three separate sections including a center section 111, a first wing 112, and a second wing 113. In one example, each of the center section 111, first wing 112, second wing 113, and end caps 115 are made of multiple sheet metal components secured together. In another example, the back pan 110 is made of a single piece of sheet material that is attached to the end caps 115. In another example, the back pan 110 and end caps 115 are made from a single piece of sheet metal formed into the desired shape. In examples with multiple pieces, the pieces are connected together in various manners, including but not limited to mechanical fasteners and welding.

Figure 4:
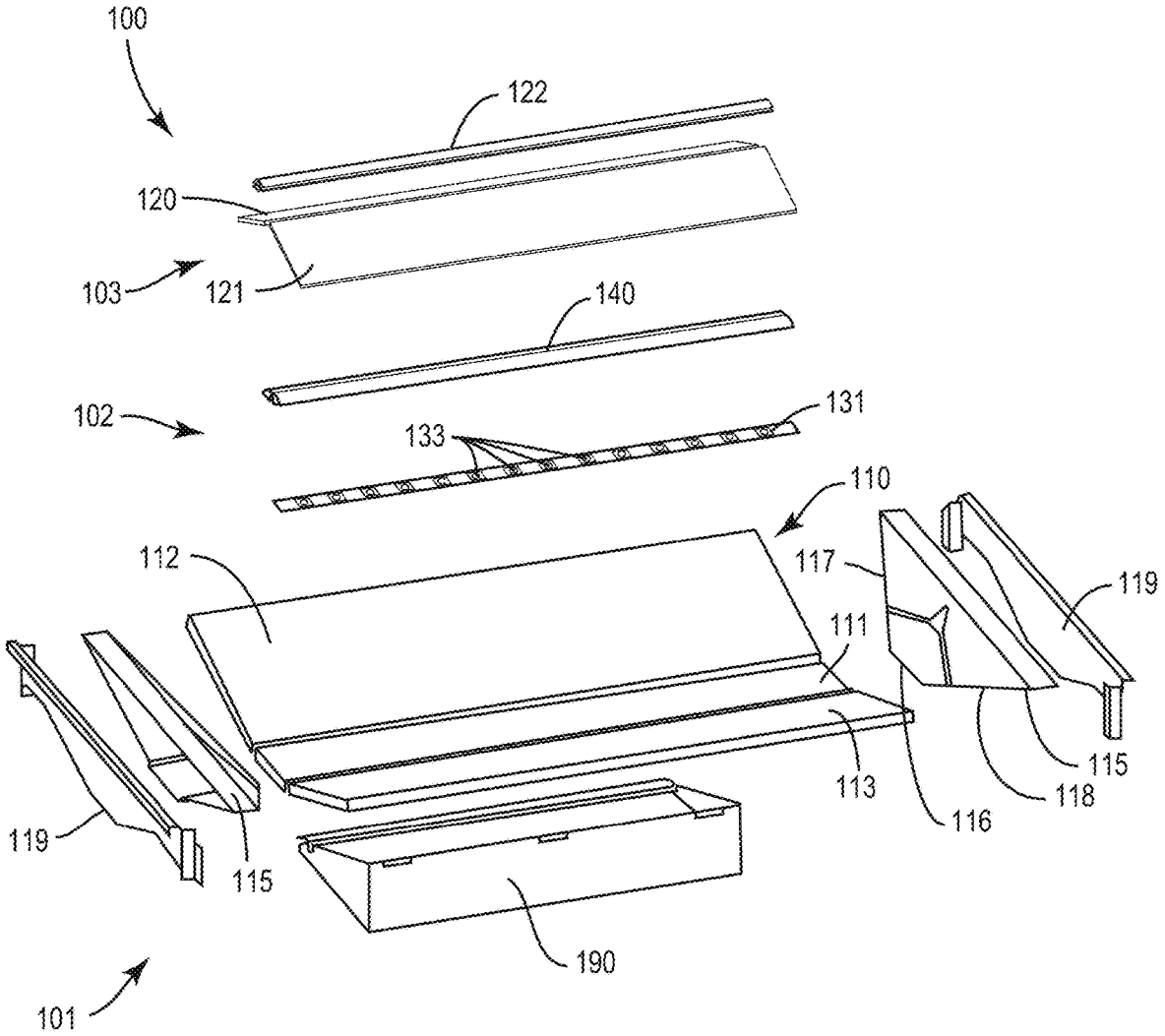
FIG. 4 is an exploded view of a light fixture.

As illustrated in FIG. 4, outer support members 119 can extend over and are connected to the outer sides of the end caps 115. In another example, the housing 101 includes the back pan 110, but does not include end caps 115.

The exposed surfaces of the back pan 110 and end caps 115 may be made of or coated with a reflective metal, plastic, or white material. One suitable metal material to be used for the reflective surfaces of the panels is aluminum (Al). The reflective surfaces may also include diffusing components if desired. For many lighting applications, it is desirable to present a uniform, soft light source without unpleasant glare, color striping, or hot spots. Thus, one or more sections of the housing 101 can be coated with a reflective material, such as a microcellular polyethylene terephthalate (MCPET) material or a DuPont/WhiteOptics material, for example. Other white diffuse reflective materials can also be used. One or more sections of the housing 101 may also include a diffuse white coating.

Figure 3:
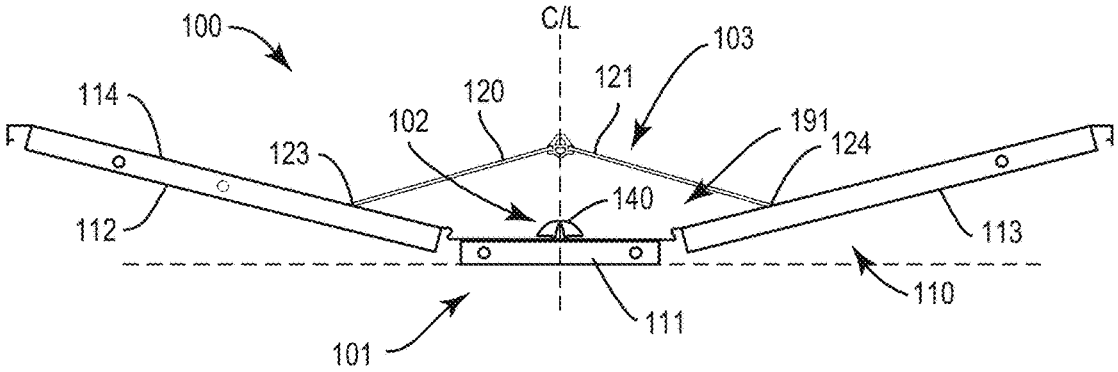
FIG. 3 is a side schematic view of a housing, LED assembly, inner lens, and lens assembly of a light fixture.
Figure 5:
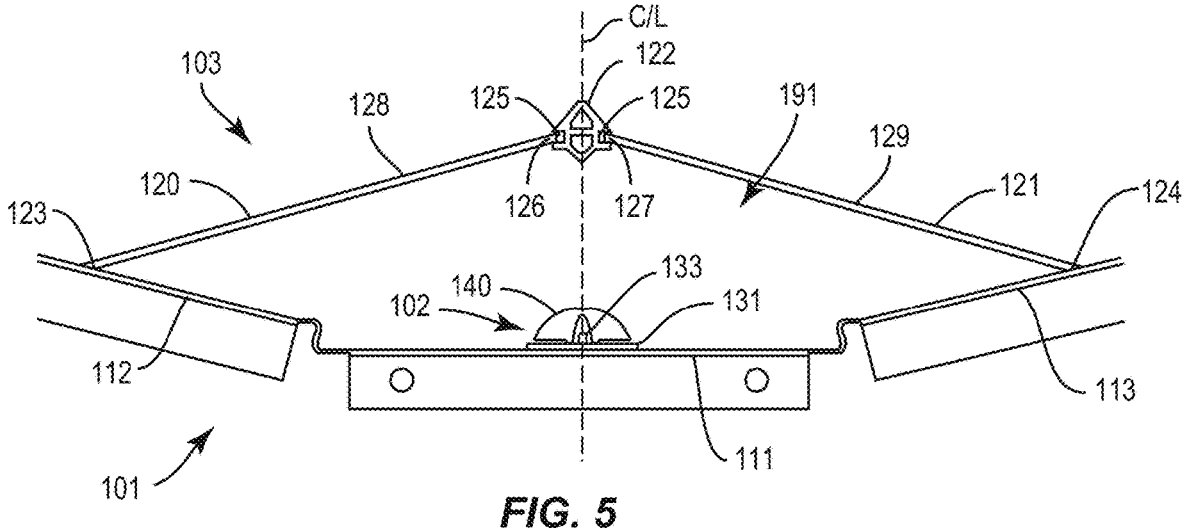
FIG. 5 is a partial side schematic view of a housing, LED assembly, inner lens, and lens assembly of a light fixture.

A lens assembly 103 is attached to the housing 101. The lens assembly 103 includes a pair of flat fixture lenses 120, 121. As illustrated in FIGS. 3 and 5, an outer end 123 of lens 120 is positioned at the first wing 112 of the back pan 110 and an outer end 124 of lens 121 is positioned at the second wing 113. In one example, the outer ends 123, 124 abut against the respective wings 112, 113, and can be connected by one or more of mechanical fasteners and adhesives. In another example, the outer ends 123, 124 are spaced away from the respective wings 112, 113.

A connector 122 is positioned between and connects together the lenses 120, 121. The connector 122 includes slots 125 that receive the inner ends 126, 127 respectively of the lenses 120, 121. The connector 122 is positioned along the centerline C/L. In one example, the connector 122 is centered on the centerline C/L.

In one example, each lens 120, 121 is a single piece. In other examples, one or both lenses 120, 121 are constructed from two or more pieces. The lenses 120, 121 can be constructed from various materials, including but not limited to plastic, such as extruded plastic, and glass. In one example, the entire lenses 120, 121 are light transmissive and diffusive. In one example, one or more sections of the lenses 120, 121 are clear. The outer surfaces 128, 129 of the lenses 120, 121 may be uniform or may have different features and diffusion levels. In another example, one or more sections of one or more of the lenses 120, 121 is more diffuse than the remainder of the lens 120, 121.

In one example, each of the lenses 120, 121 are flat with a constant thickness across the length and width. In other examples, one or both the lenses 120, 121 include variable thicknesses. In one example, each of the lenses 120, 121 is identical thus allowing a single part to function as either section and reduce the number of separate components in the design of the light fixture 100.

The housing 101 and lens assembly 102 form an interior space 191 that houses the LED assembly 102 and inner lens 140. The interior space 191 may be sealed to protect the LED assembly 102 and inner lens 140 and prevent the ingress of water and/or debris.

The LED assembly 102 includes LED elements 133 aligned in an elongated manner that extends along the back pan 110. In one example, the LED assembly 102 extends the entire length of the back pan 110 between the end caps 115. In another example, the LED assembly 102 extends a lesser distance and is spaced away from one or both of the end caps 115. In one example, the LED assembly 102 is aligned with the longitudinal axis A (FIG. 1) of the light fixture 100 and is mounted to the center section 111 of the back pan 110.

Figure 6:
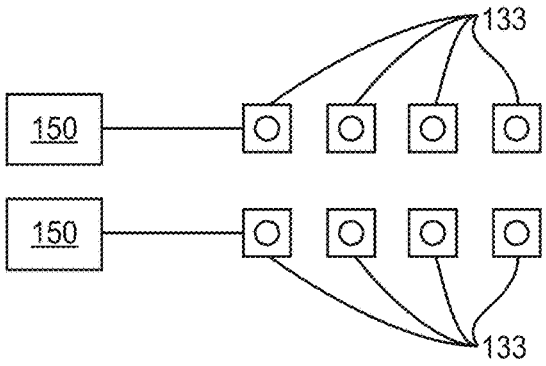
FIG. 6 is a schematic diagram of multiple driver circuits that operate LED elements.

The LED assembly 102 includes the LED elements 133 and a substrate 131. The LED elements 133 can be arranged in a variety of different arrangements. In one example as illustrated in FIG. 4, the LED elements 133 are aligned in a single row. In another example as illustrated in FIG. 6, the LED elements 133 are aligned in two or more rows. The LED elements 133 can be arranged at various spacings. In one example, the LED elements 133 are equally spaced along the length of the back pan 110. In another example, the LED elements 133 are arranged in clusters at different spacings along the back pan 110.

The LED assembly 102 can include various LED elements 133. In the various examples, the LED assembly 102 can include the same or different LED elements 133. In one example, the multiple LED elements 133 are similarly colored (e.g., all warm white LED elements 133). In such an example all of the LED elements are intended to emit at a similar targeted wavelength; however, in practice there may be some variation in the emitted color of each of the LED elements 133 such that the LED elements 133 may be selected such that light emitted by the LED elements 133 is balanced such that the light fixture 100 emits light at the desired color point.

In one example, each LED element 133 is a single white or other color LED chip or other bare component. In another example, each LED element 133 includes multiple LEDs either mounted separately or together. In the various embodiments, the LED elements 133 can include, for example, at least one phosphor-coated LED either alone or in combination with at least one color LED, such as a green LED, a yellow LED, a red LED, etc.

In various examples, the LED elements 133 of similar and/or different colors may be selected to achieve a desired color point.

In one example, the LED assembly 102 includes different LED elements 133. Examples include blue-shifted-yellow LED elements ("BSY") and a single red LED elements ("R"). Once properly mixed the resultant output light will have a "warm white" appearance. Another example uses a series of clusters having three BSY LED elements 133 and a single red LED element 133. This scheme will also yield a warm white output when sufficiently mixed. Another example uses a series of clusters having two BSY LED elements 133 and two red LED elements 133. This scheme will also yield a warm white output when sufficiently mixed. In other examples, separate blue-shifted-yellow LED elements 133 and a green LED element 133 and/or blue-shifted-red LED element 133 and a green LED element 133 are used. Details of suitable arrangements of the LED elements 133 and electronics for use in the light fixture 1 are disclosed in U.S. Pat. No. 9,786,639, which is incorporated by reference herein in its entirety.

The LED assembly 102 includes a substrate 131 that supports and positions the LED elements 133. The substrate 131 can include various configurations, including but not limited to a printed circuit board and a flexible circuit board. The substrate 131 can include various shapes and sizes depending upon the number and arrangement of the LED elements 133.

As illustrated in FIG. 5, the LED assembly 102 is centered along the centerline C/L of the light fixture 100. The connector 122 positioned between the lenses 120, 121 is also positioned along the centerline C/L. The centerline C/L also extends through the center of the back pan 110 which can include the center of the center section 111.

Each LED element 133 receives power from an LED driver circuit or power supply of suitable type, such as a SEPIC-type power converter and/or other power conversion circuits. At the most basic level a driver circuit 150 may comprise an AC to DC converter, a DC to DC converter, or both. In one example, the driver circuit 150 comprises an AC to DC converter and a DC to DC converter. In another example, the AC to DC conversion is done remotely (i.e., outside the fixture), and the DC to DC conversion is done at the driver circuit 150 locally at the light fixture 100. In yet another example, only AC to DC conversion is done at the driver circuit 150 at the light fixture 100. Some of the electronic circuitry for powering the LED elements 133 such as the driver and power supply and other control circuitry may be contained as part of the LED assembly 102 or the electronics may be supported separately from the LED assembly 130.

In one example, a single driver circuit 150 is operatively connected to the LED elements 133. In another example as illustrated in FIG. 6, two or more driver circuits 150 are connected to the LED elements 133.

Figure 7:
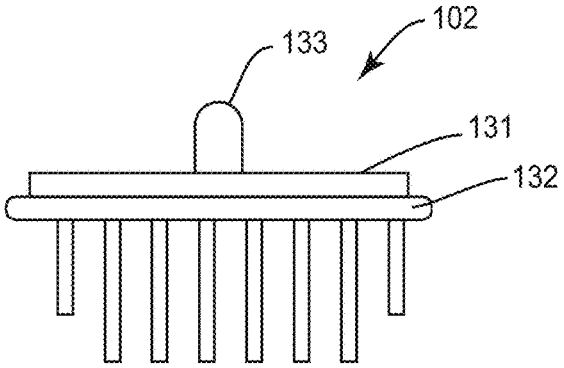
FIG. 7 is a side schematic diagram of an LED assembly mounted to a heat sink.

In one example as illustrated in FIG. 7, the LED assembly 102 is mounted on a heat sink 132 that transfers away heat generated by the one or more LED elements 133. The heat sink 132 provides a surface that contacts against and supports the substrate 131. The heat sink 132 further includes one or more fins for dissipating the heat. The heat sink 132 cools the one or more LED elements 133 allowing for operation at desired temperature levels. It should be understood that FIG. 7 provides an example only of the heatsink 132 as many different heatsink structures could be used with an embodiment of the present invention.

In one example, the substrate 131 is attached directly to the housing 101. In one specific example, the substrate 131 is attached to the back pan 110. The substrate 131 can be attached to the center section 111, or to one of the first and second wings 112, 113. The attachment provides for the LED assembly 102 to be thermally coupled to the housing 101. The thermal coupling provides for heat produced by the LED elements 133 to be transferred to and dissipated through the housing 101.

As illustrated in FIG. 4, a control box 190 is attached to the housing 101. In one example, the control box 190 is attached to the underside of the second wing 113. The control box 190 can also be positioned at other locations. The control box 190 extends around and forms an enclosed interior space configured to shield and isolate various electrical components. In one example, one or more driver circuits 150 are housed within the control box 190. Electronic components within the control box 190 may be shielded and isolated.

Examples of troffer light fixtures with a housing 101 and LED assembly 102 are disclosed in: U.S. Pat. Nos. 10,508,794, 10,247,372, and 10,203,088 each of which is hereby incorporated by reference in their entirety.

An inner lens 140 is positioned in the interior space 191 and over the LED elements 133. In one example, the inner lens 140 extends the entirety of the back pan 110. In another example, the inner lens 140 is positioned inward from one or both ends of the back pan 110.

Figure 8:
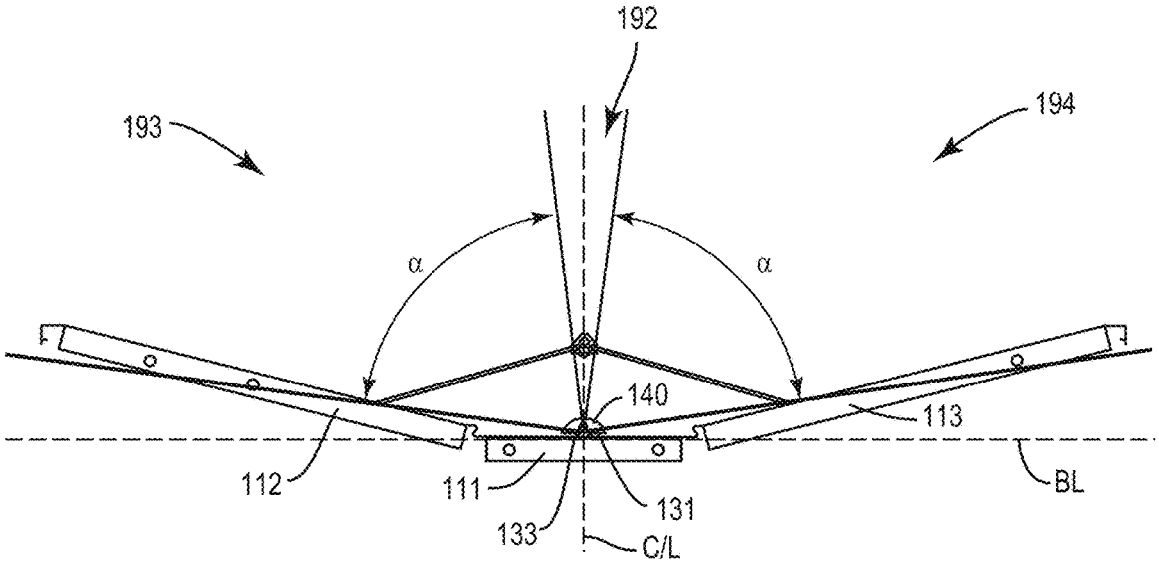
FIG. 8 is a schematic diagram of a light fixture that distributes light into lateral light zones and away from a center zone.

As illustrated in FIG. 8, the inner lens 140 directs the light from the LED elements 133 away from a center zone 192 along the centerline C/L and into lateral light zones 193, 194. The centerline C/L lies in a plane that bisects the light fixture 100 along the width and divides the light fixture 100 into first and second lateral sections. The centerline C/L extends through the connector 122 that connects together the inner ends 126, 127 of the fixture lenses 120, 121. The center zone 192 is centered on the centerline C/L. In one example, the center zone 192 extends 10° on each side of the centerline C/L (i.e., +/−10°). In another example, the center zone 192 is smaller (e.g., extends about 5° on each side of the centerline C/L). In another example, the center zone 192 is larger (e.g., extends about 15° on each side of the centerline C/L). In the various examples, the center zone 192 is centered on the centerline C/L and extends outward an equal amount on each lateral side.

The light zones 193, 194 are positioned on opposing lateral sides of the center zone 192. Light zone 193 extends between the center zone 192 and the first wing 112 of the back pan 110. Light zone 194 extends between the center zone 192 and the second wing 113 of the back pan 110. The light zones 193, 194 have equal sizes and are defined by the angle $\alpha$ formed between the respective edge of the center zone 192 and respective first and second wings 112, 113. In one example, the angle $\alpha$ is about 72°. Light zones 193, 194 can be larger or smaller depending upon the size of the center zone 192 and/or angular orientation of the first and second wings 112, 113.

A baseline BL lies in a plane that is perpendicular to the plane of the centerline C/L. In one example, the baseline BL extends along the surface of the substrate 131. In another example, the baseline BL is aligned along a bottom edge of the inner lens 40. In one example, the top surfaces of the first and second wings 112, 113 are each aligned at an angle of between about 5°-15° with the baseline BL. In one specific embodiment, the first and second wings 112, 113 are aligned at an angle of about 8° with the baseline BL.

The inner lens 140 provides for light rays to illuminate both light zones 193, 194 and provide for uniform luminance. The inner lens 140 provides for symmetrical lighting within both light zones 193, 194. In one example, the inners lens 140 provides for no light to be distributed into the center zone 192. In another example, a limited amount of light may be transmitted into the center zone 192.

Figure 9:
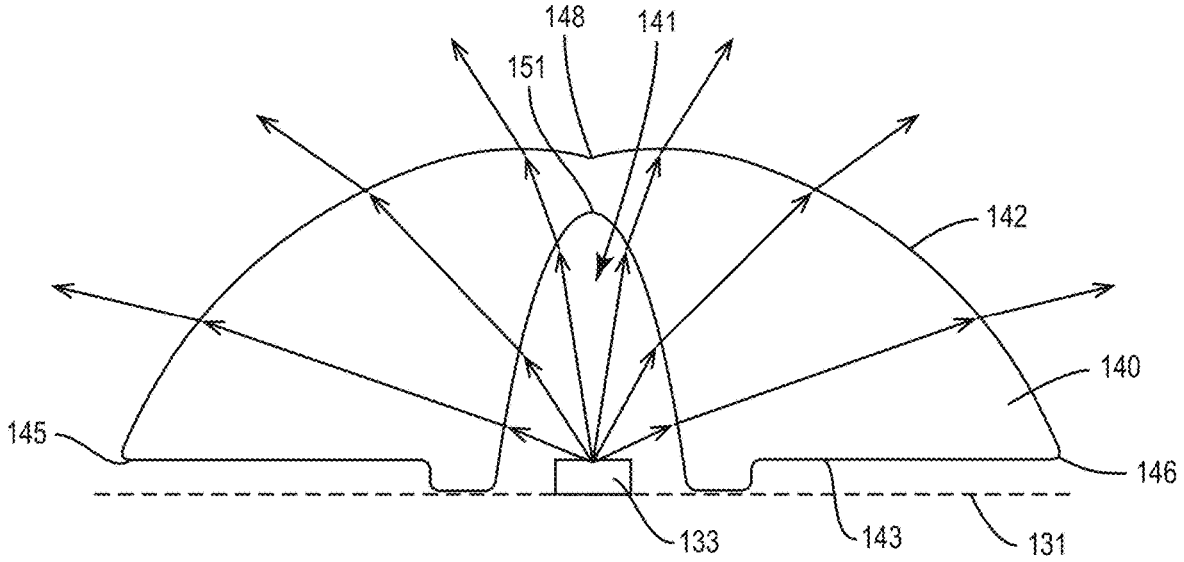
FIG. 9 is a schematic diagram of light rays distributed through an inner lens.

FIG. 9 illustrates an inner lens 140 that includes a cavity 141 that extends the length of the inner lens 140 and is positioned over the LED elements 133. The inner lens 140 also includes an outer surface 142 spaced on the opposing surface away from the cavity 141. A bottom edge 143 extends along the bottom of the inner lens 140. The bottom edge 143 can include various shapes that can be flat or uneven (as illustrated in FIG. 9).

The inner lens 140 includes an elongated shape along a first axis to extend along the back pan 110. The inner lens 140 is a diverging cylindrical lens. That is, the inner lens 140 is cylindrical lens along a first axis (e.g., along the length or y-axis) and a diverging lens (or negative lens) in a second axis (e.g., an x-axis) as illustrated in FIG. 9.

The inner lens 140 is a negative lens that diverges light along the axis that is perpendicular to the centerline C/L as the inner lens 140 is assembled. The light rays are refracted on the steep inner surface of the cavity 141 and then pass through the lens 140 and are further refracted for wide distribution. The inner lens 140 transfers the light rays outward in wide angles without overlap. This enables the light to have a smooth distribution without shadows or hotspots. The inner lens 140 is shaped with the lens thickness gradually and symmetrically increasing from the center (at a peak 151 of the cavity 141) to each lateral end 145, 146. The surfaces of the cavity 141 and outer surface 142 have slowly varying curvatures so that light can be uniformly distributed on the whole target surface. The slowly varying curvature may diminish shadows or hot spots which may be generated on the fixture lenses 120, 121.

In one example, the inner lens 140 has no total internal reflection portions on the whole outer surface 142. Instead, light rays are refracted smoothly and sequentially without shadows or hot spots.

The cavity 141 has a steep but smooth surface for light coupling so that light rays are refracted towards the inside of the inner lens 140 in wide angles to help in shaping the wide light distribution. The slowly varying surface enables smooth and sequential light refraction and wide distribution without interactions among light rays to form uniform luminance in the target area.

As illustrated in FIG. 9, the cavity 141 includes a peak 151. The peak 151 is located at the center of the cavity 141. The outer surface 142 can include a dimple 148. In one example, the peak 151 and the dimple 148 are both aligned with the centerline C/L. A straight line that extends through the peak 151 and the dimple 148 divides the inner lens 140 into two sections that have equal shapes and sizes. The inner lens 140 is symmetrical about the line. A thickness of the inner lens 140 is measured between the cavity 141 and the outer surface 142. The minimum thickness is located along the line.

Figure 10:
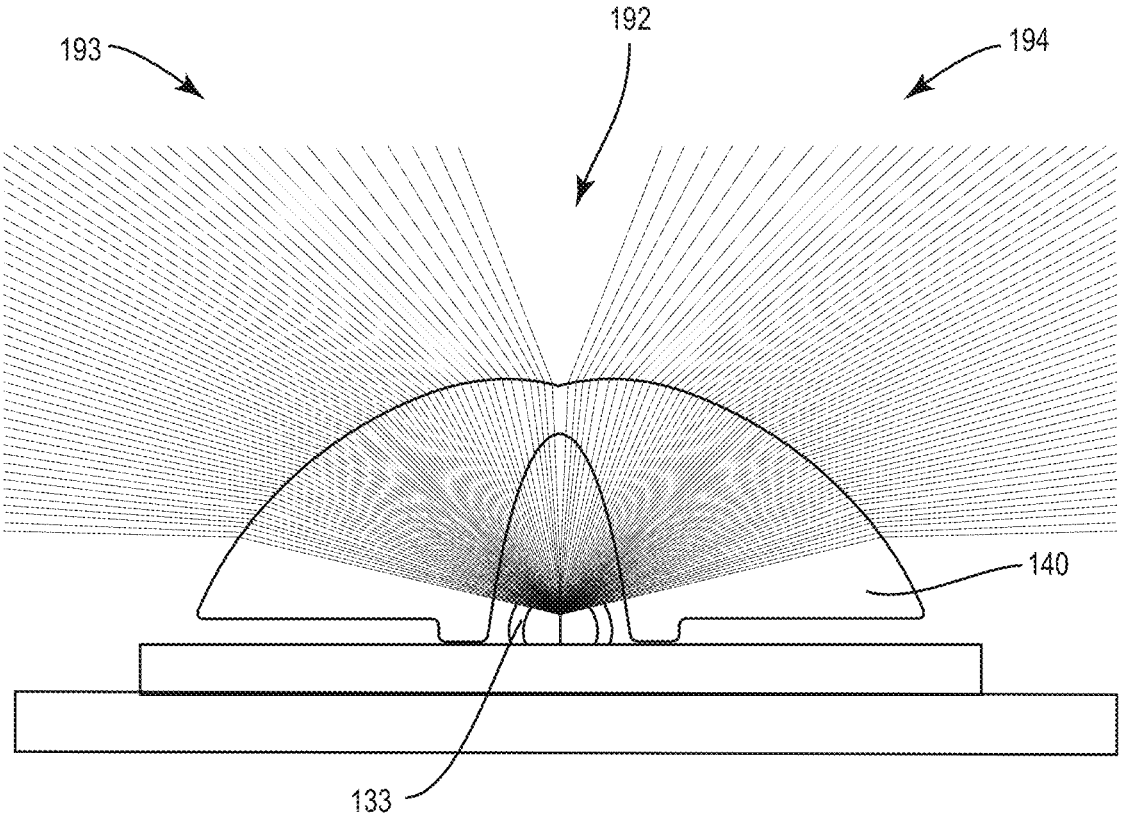
FIG. 10 is schematic diagram of a ray fan of light rays propagating through and from an inner lens.

FIG. 10 illustrates a ray fan of light rays propagating through and from the inner lens 140. The inner lens 140 smoothly distributes the light rays without interaction into the light zones 193, 194. The light rays distributed within the light zones 193, 194 are greater at wide angles towards the outer edges than at more narrow angles towards the edges at the center zone 192. In one example, the light rays are divided into increasing outgoing angular spacing sequentially from the lower to the upper side. The same light distribution is obtained in both light zones 193, 194 as the inner lens 140 provides for symmetrical light distribution within each of the light zones 193, 194. The ray fan illustrates that the light rays have equal incident angular spacing with the light rays divided symmetrically and sequentially. The center zone 192 includes no light rays as the inner lens 140 blocks light rays from entering this zone.

Figure 10A:
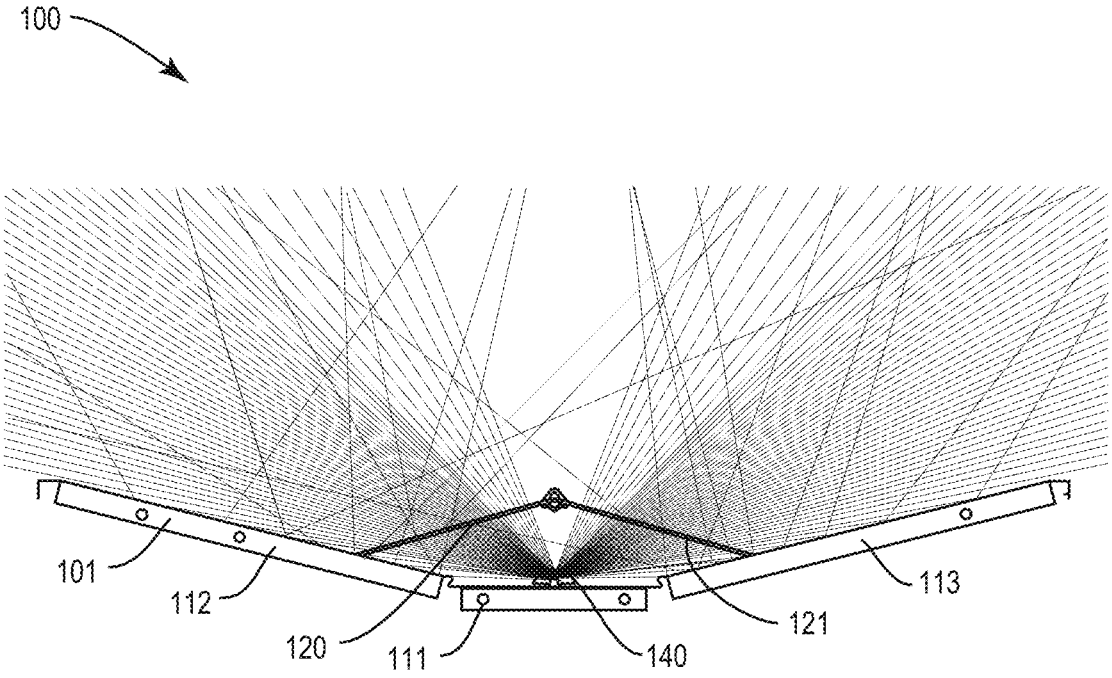
FIG. 10A is a schematic diagram of distribution of light rays from a light fixture.

FIG. 10A illustrates a distribution of light rays from the light fixture 100. A majority of the light is distributed outward from the inner lens 140 into the light zones 193, 194 without reflecting from the housing 101. Some portion of the light is reflected from the housing 101. The light from the inner lens 140 forms a wide luminance pattern that substantially fills each of the fixture lenses 120, 121. These fixture lenses 120, 121 are substantially illuminated across their widths. In one example, some light may enter the center zone 192 because individual LED elements 133 are extended sources and each has the strongest intensity in the center zone 192.

The light fixture 100 includes a single inner lens 140. The inner lens 140 can include various design features. In the various examples, the inner lens 140 is designed to diverge light (i.e., a negative lens) along one axis and to symmetrically distribute the light into two sides. The inner lens 140 can be constructed from a variety of materials, including but not limited to acrylic, transparent plastics, and glass. FIGS. 11-14 illustrate different examples of an inner lens 140 that can be used in the light fixture 100. Each includes different aspects that affect the light distribution.

Inner Lens 1

Figure 11A:
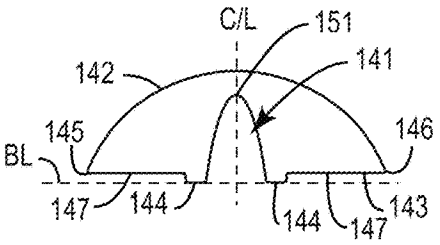
FIG. 11A is an end view of the inner lens of FIG. 11.
Figure 11:
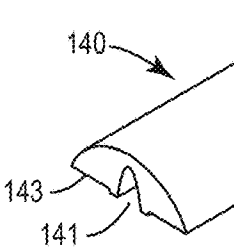
FIG. 11 is a partial perspective view of an inner lens.

FIGS. 11 and 11A illustrate a first inner lens 140. The inner cavity 141 includes a steep shape with a peak aligned along the centerline C/L. The outer surface 142 includes a continuous shape that extends between the lateral ends 145, 146. In one example, the radius of the outer surface 142 is about 11.85 mm. The bottom edge 143 includes a pair of projections 144 on opposing sides of the inner cavity 141. The sections 147 that extend between the projections 144 and lateral sections beyond the projections 144 to the ends 145, 146 are co-planar. In one example, the sections 147 are parallel with the baseline BL (and perpendicular to the centerline C/L). The inner lens 140 includes a width measured between the lateral ends 145, 146 of about 22.1 mm and a height at the cavity 141 measured along the centerline C/L of about 8.1 mm. The inner lens 140 is symmetrical about a straight line that extends between the peak 151 and the dimple 148.

Inner Lens 2

Figure 12A:
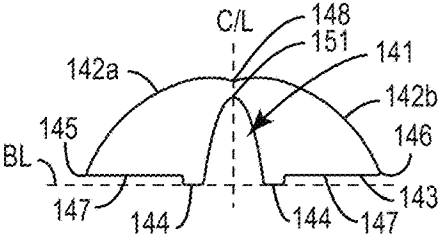
FIG. 12A is an end view of the inner lens of FIG. 12.
Figure 12:
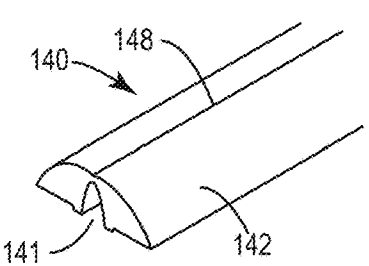
FIG. 12 is a partial perspective view of an inner lens.

FIGS. 12 and 12A illustrate a second inner lens 140. The inner lens 140 is symmetrical about a straight line that extends between the peak 151 and the dimple 148. The inner cavity 141 includes a steep shape with a peak 151 aligned along the centerline C/L. The outer surface 142 includes the dimple 148 at the centerline C/L. The dimple 148 divides the outer surface 142 into first and second lateral sections 142*a*, 142*b*. The first lateral section 142*a* extends between the lateral end 145 and the dimple 148. The second lateral section 142*b* extends between the lateral end 146 and the dimple 148. In one example, the radius of each of the lateral sections 142*a*, 142*b* is about 11.85 mm from the respective lateral edge 145, 146 to a point prior to the start of the dimple 148. The bottom edge 143 includes a pair of projections 144 on opposing sides of the inner cavity 141. The sections 147 that extend between the projections 144 and lateral ends 145, 146 are co-planar. In one example, the sections 147 are parallel with the baseline BL (and perpendicular to the centerline C/L). The inner lens 140 includes a width measured between the lateral ends 145, 146 of about 22.1 mm and a height at the cavity 141 measured along the centerline C/L of about 8.0 mm.

Inner Lens 3

Figure 13A:
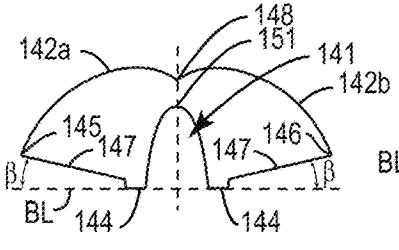
FIG. 13A is an end view of the inner lens of FIG. 13.
Figure 13:
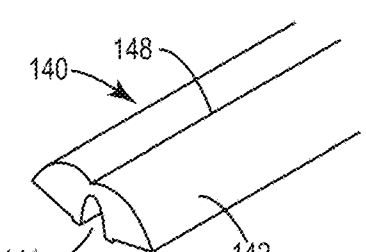
FIG. 13 is a partial perspective view of an inner lens.

FIGS. 13 and 13A illustrate a third inner lens 140. The inner lens 140 is symmetrical about a straight line that extends between the peak 151 and the dimple 148. The inner cavity 141 includes a wider shape than the first and second inner lenses (i.e., FIGS. 11, 11A, 12, 12A). The peak 151 is positioned on the centerline C/L and is flatter than those of the first and second inner lenses. The outer surface 142 includes first and second sections 142*a*, 142*b* that meet at the dimple 148 that is positioned on the centerline C/L. The depth of the dimple 148 measured from the upper extent of the first and second sections 142*a*, 142*b* is deeper than the second inner lens. The bottom edge 143 includes a pair of projections 144 and sections 147 that extend outward to the lateral ends 145, 146. The sections 147 are positioned at an acute angle β relative to the baseline BL (that is perpendicular to the centerline C/L). The inner lens 140 includes a width measured between the lateral ends 145, 146 of about 22.7 mm and a height at the cavity 141 measured along the centerline C/L of about 8.8 mm.

Inner Lens 4

Figure 14A:
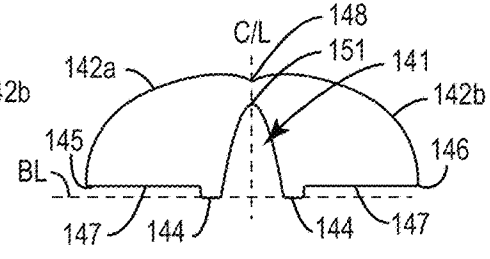
FIG. 14A is an end view of the inner lens of FIG. 14.
Figure 14:
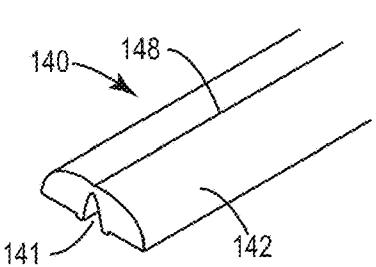
FIG. 14 is a partial perspective view of an inner lens.

FIGS. 14 and 14A illustrate a fourth inner lens 140. The fourth inner lens 140 includes a cavity 141 with a steeper shape than the third inner lens. The inner lens 140 is symmetrical about a straight line that extends between the peak 151 and the dimple 148. In one example, the cavity 141 includes the same shape and size as the cavities 141 of the first and second inner lenses (i.e., FIGS. 11, 11A, 12, 12A). The outer surface 142 includes first and second sections 142*a*, 142*b* that meet at the dimple 148. The first and second sections 142*a*, 142*b* are wider than the corresponding first and second sections 142*a*, 142*b* of the third inner lens. The width of the inner lens 140 is about 23.7 mm measured between the lateral ends 145, 146. The height of the inner lens 140 measured at the centerline C/L is about 8.7 mm. The bottom edge 143 includes projections 144 and bottom sections 147. The bottom sections 147 are aligned in a plane that is parallel to the baseline BL (that is perpendicular to the centerline C/L).

The inner lenses 140 include three features. A first feature is the dimple 148 that is symmetrical about the centerline C/L. The dimple 148 divides the light into outer directions for distribution in the light zones 193, 194 and blocks light in the center zone 192. A second feature is the symmetrical surface of the cavity 141 about the centerline C/L. A third feature is the symmetrical surface of the outer surface 142 about the centerline C/L. The second and third features enable light rays to be refracted in further wide angles. The surfaces of the inner lens 140 provide for normal refraction without total internal reflection in which the incident angle is less than the critical angle (e.g., about 42° for acrylic).

Figure 15A:
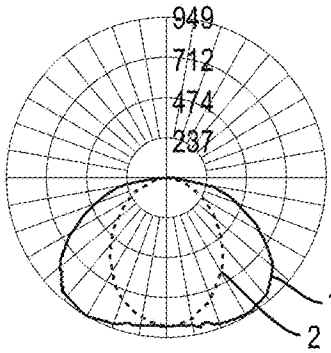
FIG. 15A is an exemplary representation of a simulated candela plot achieved with the first inner lens as in FIG. 11 with first and second plots with the first plot illustrating the intensity in a plane perpendicular to the longitudinal axis and the second plot in a plane along the longitudinal axis.
Figure 16A:
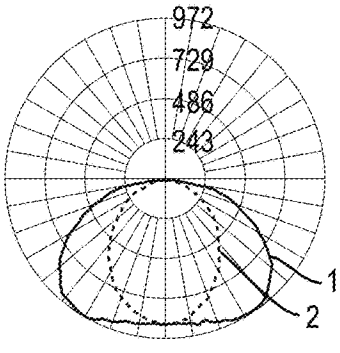
FIG. 16A is an exemplary representation of a simulated candela plot achieved with the second inner lens as in FIG. 12 with first and second plots with the first plot illustrating the intensity in a plane perpendicular to the longitudinal axis and the second plot in a plane along the longitudinal axis.
Figure 17A:
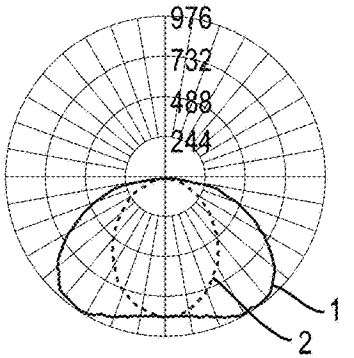
FIG. 17A is an exemplary representation of a simulated candela plot achieved with the third inner lens as in FIG. 13 with first and second plots with the first plot illustrating the intensity in a plane perpendicular to the longitudinal axis and the second plot in a plane along the longitudinal axis.
Figure 18A:
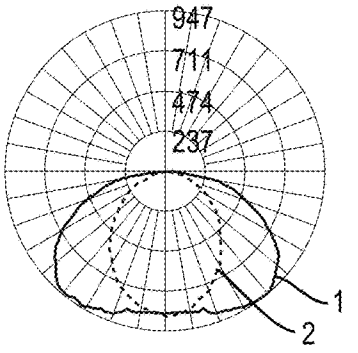
FIG. 18A is an exemplary representation of a simulated candela plot achieved with the fourth inner lens as in FIG. 14 with first and second plots with the first plot illustrating the intensity in a plane perpendicular to the longitudinal axis and the second plot in a plane along the longitudinal axis.
Figure 15B:
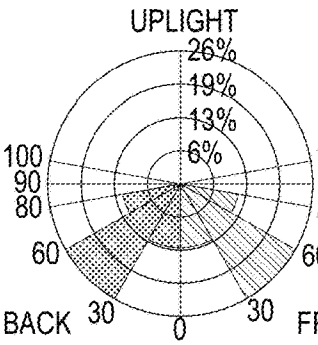
FIG. 15B illustrate luminous flux distribution patterns for a light fixture with a first inner lens as in FIG. 11.
Figure 16B:
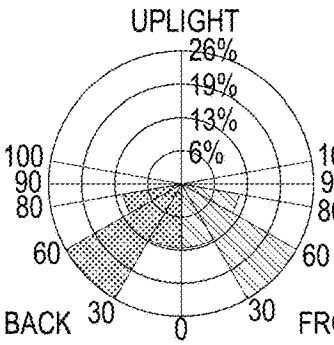
FIG. 16B illustrate luminous flux distribution patterns for a light fixture with a second inner lens as in FIG. 12.
Figure 17B:
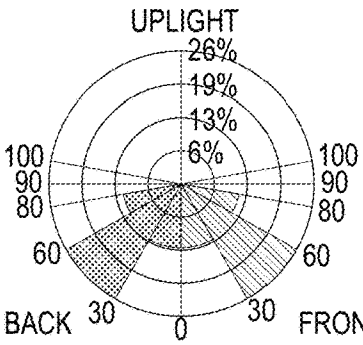
FIG. 17B illustrates luminous flux distribution patterns for a light fixture with a third inner lens as in FIG. 13.
Figure 18B:
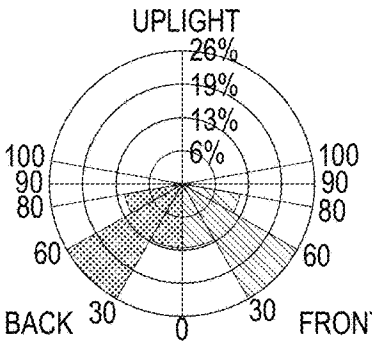
FIG. 18B illustrates luminous flux distribution patterns for a light fixture with a fourth inner lens as in FIG. 14.

Intensity and luminous flux distribution patterns are illustrated in FIGS. 15A-18B for the four different options for the inner lens 140. FIGS. 15A and 15B include the light distribution for a light fixture 100 with the first inner lens 140 (see FIGS. 11 and 11A). FIGS. 16A and 16B include the light distribution for a light fixture 100 with the second inner lens 140 (see FIGS. 12 and 12A). FIGS. 17A and 17B include the light distribution for a light fixture 100 with the third inner lens 140 (see FIGS. 13 and 13A). FIGS. 18A and 18B include the light distribution for a light fixture 100 with the fourth inner lens 140 (see FIGS. 14 and 14A).

Each of FIGS. 15A, 16A, 17A, and 18A illustrate two separate plots. The first plot 1 illustrates the intensity curve over vertical angles on the plane perpendicular to the longitudinal axis A. The second plot 2 is the intensity curve on the v-angles on the plane (parallel plane) along the longitudinal axis A. The longitudinal axis A is the axis along lined LED elements 133, the perpendicular plane is crossed to the longitudinal axis A. The parallel plane is along the longitudinal axis A. In other words, the perpendicular plane is the vertical plane crossing the longitudinal axis, or 90°-270° and parallel plane is the one along the longitudinal axis, or 0°-180°.

FIG. 15A further includes a Spacing Criterion (SC) and an optical efficiency (OE). The SC shows how much light can be distributed widely to make uniform at a given mounting height (i.e., it is the ratio of luminaires spacing to mounting height). The SC along the y-axis is 1.12 and the SC along the x-axis if 1.60. The OE is 84%.

FIG. 16A includes an SC along the y-axis of 1.12 and along the x-axis of 1.64, and an OE of 86%.

FIG. 17A includes an SC along the y-axis of 1.14 and along the x-axis of 1.74. The OE is 85%.

FIG. 18A includes an SC along the y-axis of 1.16 and along the x-axis of 1.68. The OE is 85%.

FIGS. 15B, 16B, 17B, and 18B illustrate the Luminaire Classification System (LCS). The LCS illustrates lumens distribution over angles as % of total fixture lumens. Each of the inner lenses 140 were measured for FL is front low (angle), FM is front medium angle, FH is front high angle, FVH is front very high angle, BL is back low angle, BM is back medium angle, BH is back high angle, UL is uplight low angle, and UH is uplight high angle. For these measurement, low is between 0-30°, medium is between 30-60°, high is between 60-80°, and very high is between 80-90°, uplight low is between 90-100°, and uplight high is between 100-180°.

The first inner lens 140 (FIG. 15B) includes the following: FL=12.7%; FM=25.8%; FH=10.6%; FVH=1.0%; BL=12.7%; BM=25.8%; BH=10.6%; BVH=1.0%; UL=0.0%; and UH=0.0%.

The second inner lens 140 (FIG. 16B) includes the following: FL=12.5%; FM=25.9%; FH=10.6%; FVH=1.0%; BL=12.5%; BM=25.9%; BH=10.6%; BVH=1.0%; UL=0.0%; and UH=0.0%.

The third inner lens 140 (FIG. 17B) includes the following: FL=12.1%; FM=25.9%; FH=11.0%; FVH=1.0%; BL=12.2%; BM=25.9%; BH=11.0%; BVH=1.0%; UL=0.0%; and UH=0.0%.

The fourth inner lens 140 (FIG. 18B) includes the following: FL=12.2%; FM=25.8%; FH=11.1%; FVH=1.0%; BL=12.2%; BM=25.7%; BH=11.1%; BVH=1.0%; UL=0.0%; and UH=0.0%.

A linear array of LED elements 133 such as arranged in a troffer-style LED fixture emit a Gaussian type of light distribution with a sharp peak luminance in the center along the longitudinal axis A of the linear array. As a result, a linearly arranged LED array will typically create a bright spot along the longitudinal axis A of the light fixture 100 with dimmer lateral sides. The use of an inner lens 140 distributes the light laterally into the light zones 193, 194 and away from the center zone 192. The inner lens 140 further provides for symmetrical light distribution on opposing sides of the longitudinal axis A.

Figure 19A:
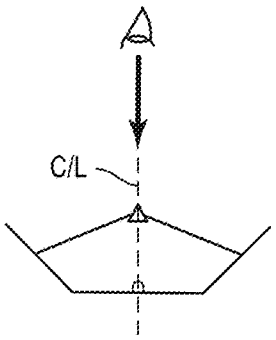
FIG. 19A is a schematic diagram of a front view viewing angle along the centerline C/L.
Figure 19B:
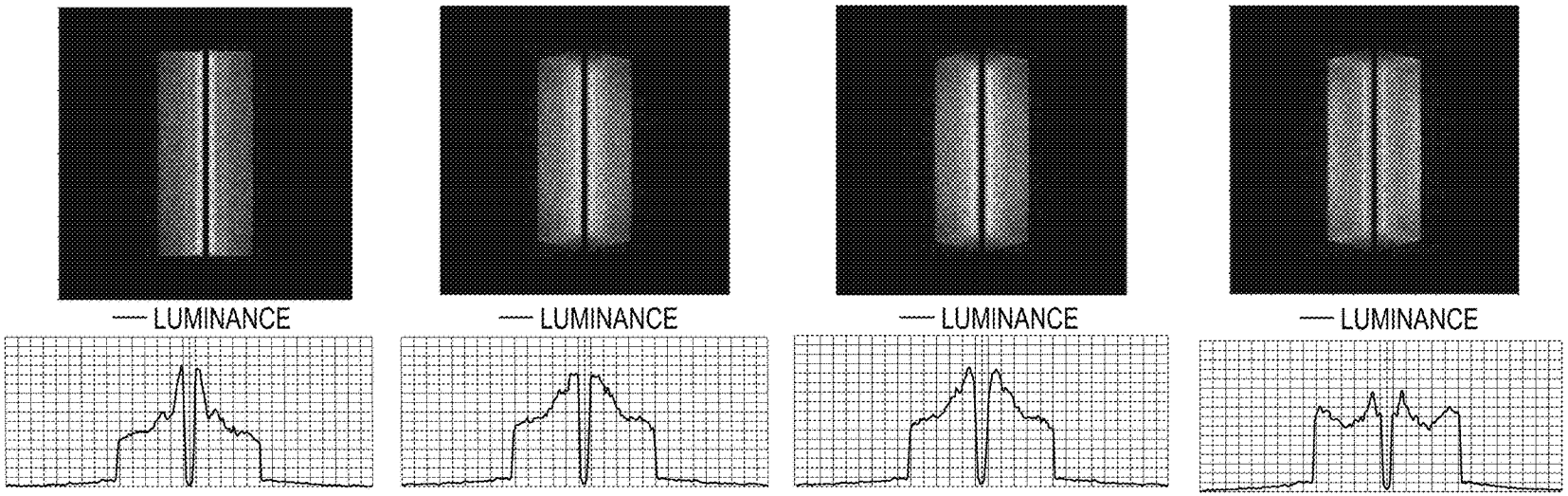
FIG. 19B are luminance appearance and luminance uniformity from the front view of the light fixtures with the first, second, third, and fourth inner lenses.

FIG. 19B illustrates the luminance uniformity from a front view of light fixtures 100 using the different inner lenses 140. As illustrated in FIG. 19A, the front view is taken along the centerline C/L of the light fixture 100. As evident, the large central peak is eliminated and light is distributed across the width.

Figure 20A:
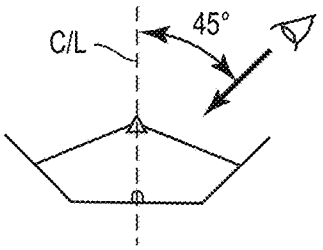
FIG. 20A is a schematic diagram of a 45° viewing angle relative to the centerline C/L.
Figure 20B:
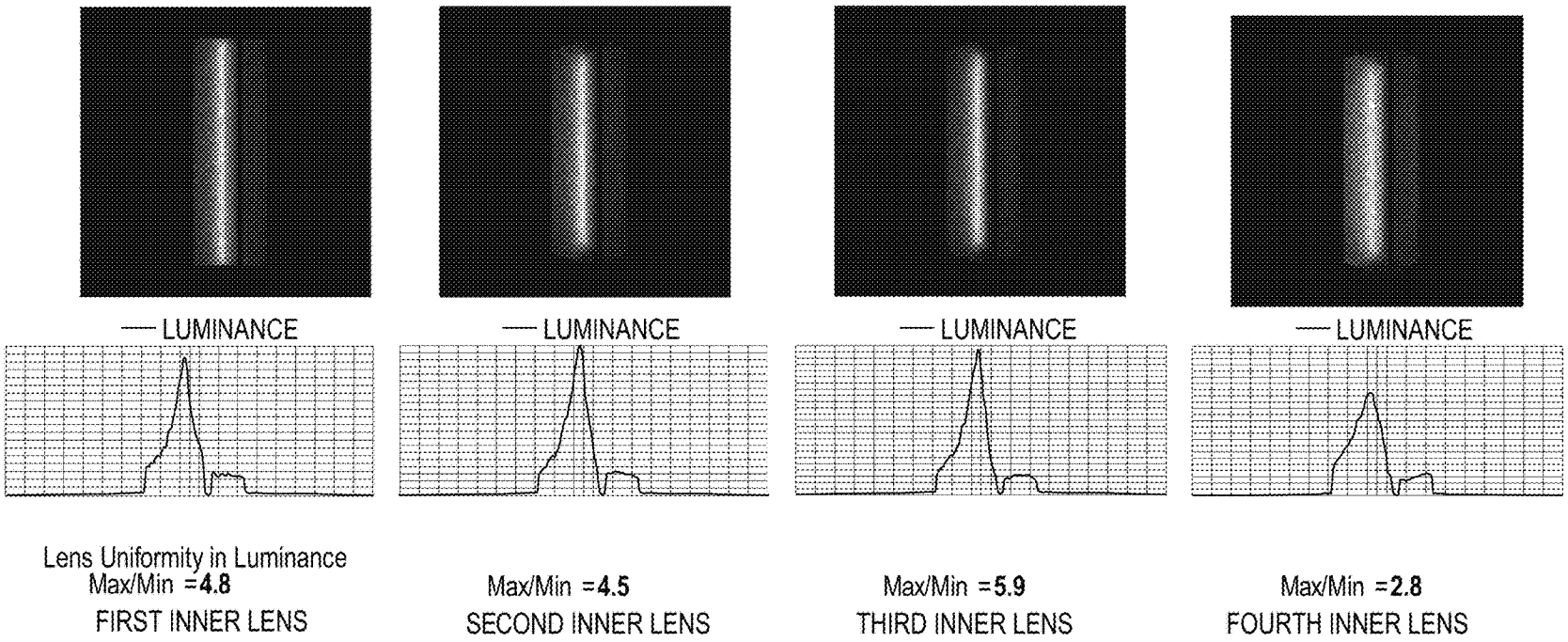
FIG. 20B are luminance appearance and luminance uniformity from the 45° viewing angle of the light fixtures with the first, second, third, and fourth inner lenses.

FIG. 20B illustrates the luminance uniformity from a 45° angle relative to the centerline C/L (see FIG. 20A).

As illustrated in FIG. 19B in the front view, each of the first, second, third, and fourth inner lenses provide a lens uniformity Max/Min between 1.6 and 2.6.

In one example, the light fixture 200 includes a lens uniformity of between about 1.5 and 2.0 in the front view. In another example, the light fixture 200 includes a lens uniformity of between about 2.0 and 4.0 in the front view.

In one example, the ratio of the maximum luminance uniformity to the minimum luminance uniformity is analyzed according to one or more IES standards, such as but not limited to RP-20 standards for outdoor use and RP-1-12 for office lighting. In one example, a maximum/minimum ratio of less than 3:1 is considered excellent. In one example, a maximum/minimum ratio of less than 5:1 is considered good.

Figure 30:
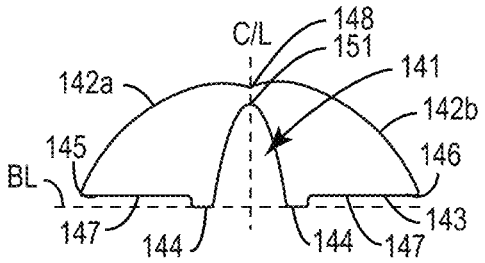
FIG. 30 is an end view of a fifth inner lens.

FIG. 30 illustrates a fifth inner lens 140. The fifth inner lens 140 includes the same outer surface as the second inner lens 140 (see FIGS. 12A and 12B) with a different inner cavity 141). The inner lens 140 is symmetrical about a straight line that extends between the peak 151 and the dimple 148. The inner cavity 141 includes a steep shape with a peak 151 aligned along the centerline C/L. The outer surface 142 includes the dimple 148 at the centerline C/L. The dimple 148 divides the outer surface 142 into first and second lateral sections 142*a*, 142*b*. The first lateral section 142*a* extends between the lateral end 145 and the dimple 148. The second lateral section 142*b* extends between the lateral end 146 and the dimple 148. The bottom edge 143 includes a pair of projections 144 on opposing sides of the inner cavity 141. The sections 147 that extend between the projections 144 and lateral ends 145, 146 are co-planar.

Figure 31:
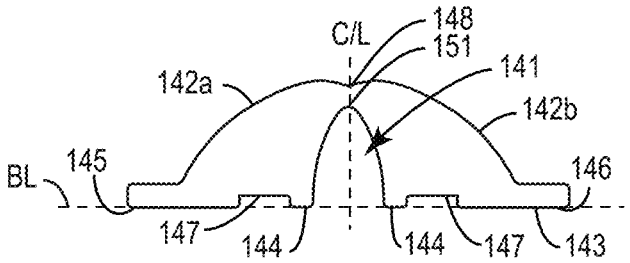
FIG. 31 is an end view of a sixth inner lens.

FIG. 31 illustrates a sixth inner lens 140. The sixth inner lens 140 is symmetrical about a straight line that extends between the peak 151 and the dimple 148. The inner cavity 141 includes a steep shape with a peak 151 aligned along the centerline C/L. A straight line that extends through the peak 151 and dimple 148 is collinear with the centerline C/L. The outer surface 142 includes the dimple 148 at the centerline C/L. The dimple 148 divides the outer surface 142 into first and second lateral sections 142*a*, 142*b*. The first lateral section 142*a* extends between a first point at a flange 290 and the dimple 148. The second lateral section 142*b* extends between the flange 290 and the dimple 148. The flange 290 extends along the bottom and extends laterally outward beyond each of the sections 142*a*, 142*b* respectively. Indents 291, 292 are formed in the bottom edge 293 of the flange along the sections 142*a*, 142*b*. In one example, the bottom edge 143 is perpendicular to the centerline C/L.

Figure 30A:
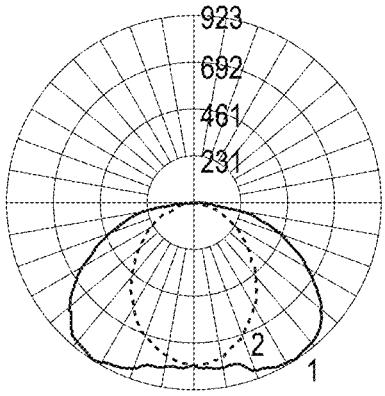
FIG. 30A is an exemplary representation of a simulated candela plot achieved with the fifth inner lens as in FIG. 30 with first and second plots with the first plot illustrating the intensity in a plane perpendicular to the longitudinal axis and the second plot in a plane along the longitudinal axis.
Figure 31A:
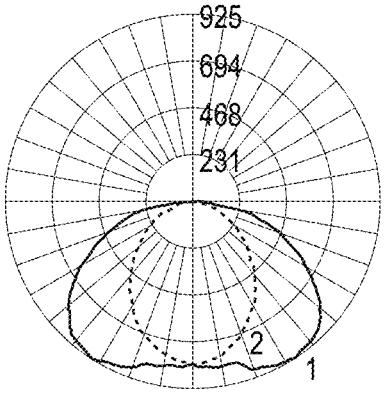
FIG. 31A is an exemplary representation of a simulated candela plot achieved with the sixth inner lens as in FIG. 31 with first and second plots with the first plot illustrating the intensity in a plane perpendicular to the longitudinal axis and the second plot in a plane along the longitudinal axis.

FIG. 30A illustrates a light distribution for a light fixture with the fifth inner lens 140. FIG. 31A illustrates the light distribution for a light fixture with the sixth inner lens 140. A first plot 1 of the intensity curve over vertical angles on the plane perpendicular to the longitudinal axis A. The second plot 2 is the intensity curve on the v-angles on the plane along the longitudinal axis A. The fifth inner lens 140 includes an SC of 1.72 and an OE is 81%. The sixth inner lens 140 includes an SC of 1.70 and an OE of 80%.

Figure 30B:
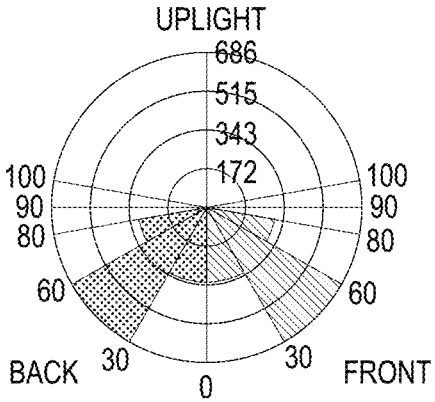
FIG. 30B illustrates luminous flux distribution patterns for a light fixture with a fifth inner lens as in FIG. 30.

FIG. 30B illustrates the LCS for the fifth inner lens 140 that includes the following: FL=12.3%; FM=25.9%; FH=10.8%; FVH=1.0%; BL=12.3%; BM=25.9%; BH=10.8%; BVH=1.0%; UL=0.0%; and UH=0.0%.

Figure 31B:
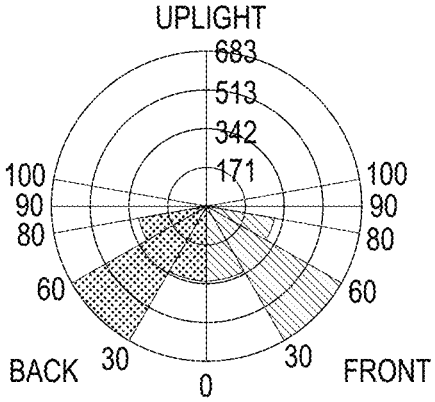

FIG. 31B illustrates the LCS for the sixth inner lens 140 that includes the following: FL=12.4%; FM=25.9%; FH=10.6%; FVH=1.0%; BL=12.4%; BM=25.9%; BH=10.6%; BVH=1.0%; UL=0.0%; and UH=0.0%.

Figure 32A:
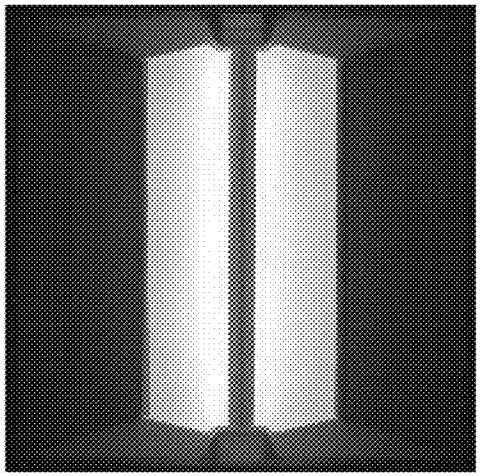
FIGS. 32A and 32B are luminance appearance and luminance uniformity from the front view of a dimmed light fixture with the fifth inner lens.
Figure 32B:
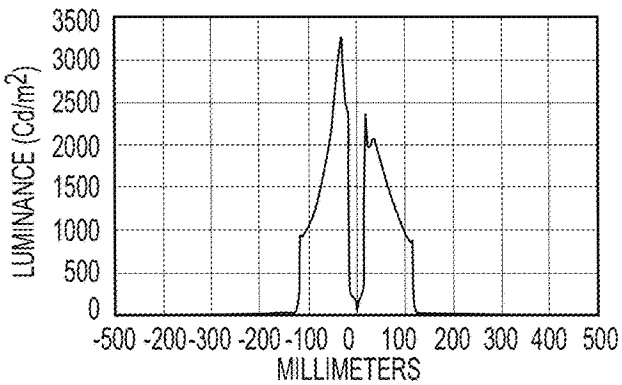
Figure 32C:
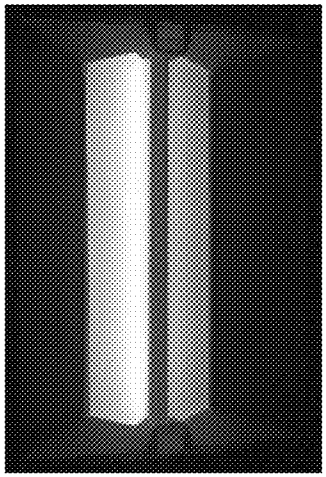
FIGS. 32C and 32D are luminance appearance and luminance uniformity from a 45° angle of a dimmed light fixture with the fifth inner lens.
Figure 32D:
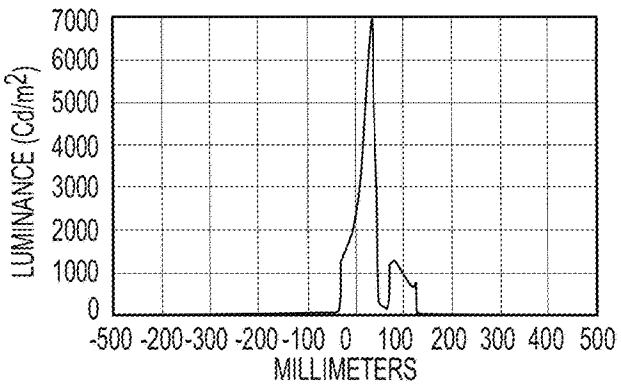

FIGS. 32A and 32B illustrate the luminance uniformity from a front view of a light fixture 100 using the fifth inner lens 140 at a dimmed level. The front view is taken along the centerline C/L of the light fixture 100. In one example, the asymmetric lighting is a result of the environment in which the light fixture 100 is positioned and/or the housing 101 (e.g., polishing process of the housing 101). FIGS. 32C and 32D illustrate the luminance uniformity of a light fixture 100 with the fifth lens 140 at a dimmed level from a 45° angle relative to the centerline C/L.

Figure 33C:
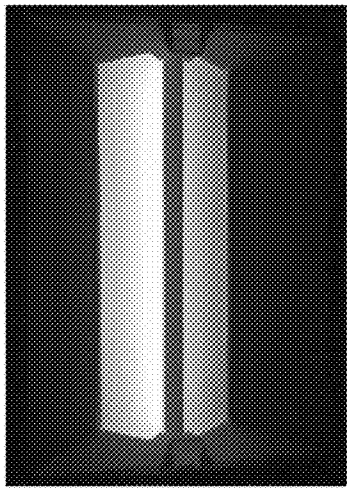
FIGS. 33C and 33D are luminance appearance and luminance uniformity from a 45° angle of a dimmed light fixture with the sixth inner lens.
Figure 33D:
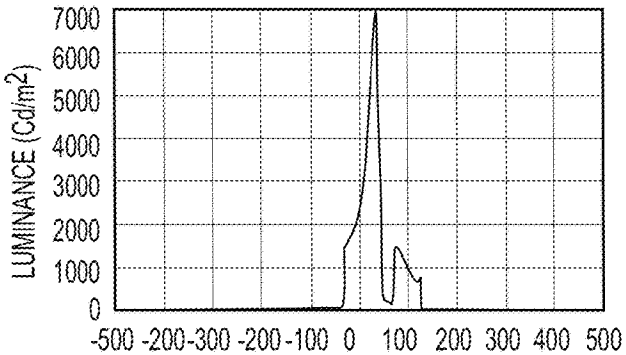
Figure 33A:
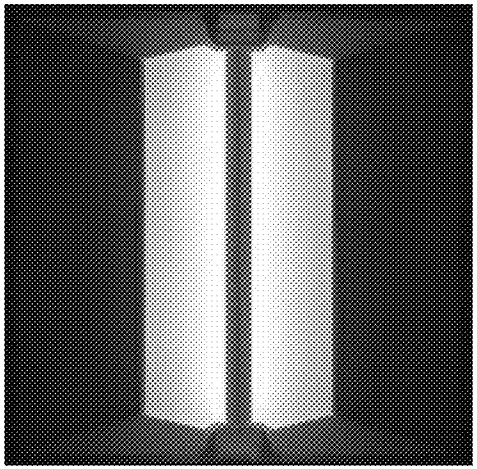
FIGS. 33A and 33B are luminance appearance and luminance uniformity from the front view of a dimmed light fixture with the sixth inner lens.
Figure 33B:
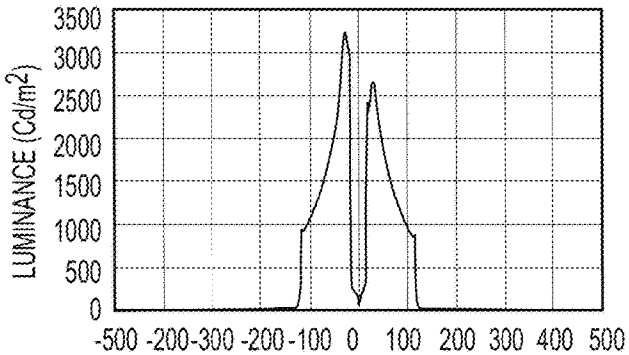

FIGS. 33A and 33B illustrate the luminance uniformity from a front view of a light fixture 100 using the sixth inner lens 140 at a dimmed level. The front view is taken along the centerline C/L of the light fixture 100. In one example, the asymmetric lighting is a result of the environment in which the light fixture 100 is positioned and/or the housing 101 (e.g., polishing process of the housing 101). FIGS. 33C and 33D illustrate the luminance uniformity of a light fixture 100 with the sixth lens 140 at a dimmed level from a 45° angle relative to the centerline C/L.

Figure 34A:
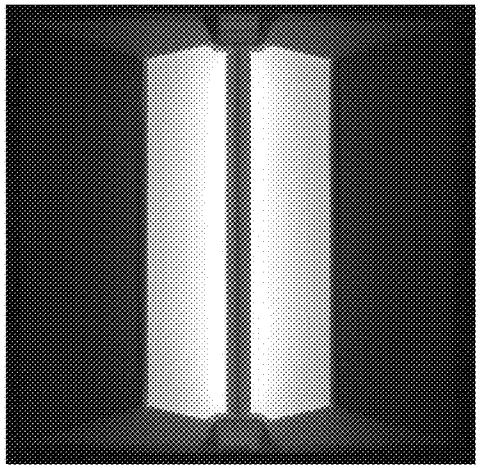
FIGS. 34A and 34B are luminance appearance and luminance uniformity from the front view of a full level light fixture with the sixth inner lens.
Figure 34B:
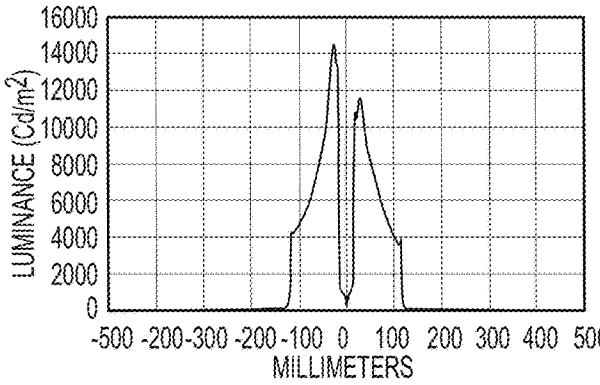
Figure 34C:
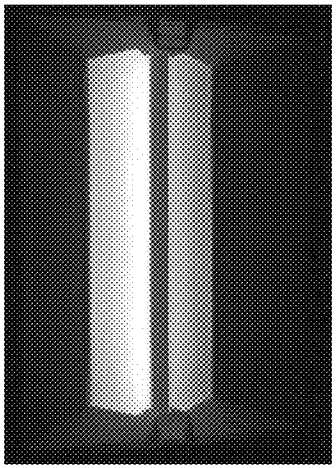
FIGS. 34C and 34D are luminance appearance and luminance uniformity from a 45° angle of a full level light fixture with the sixth inner lens.
Figure 34D:
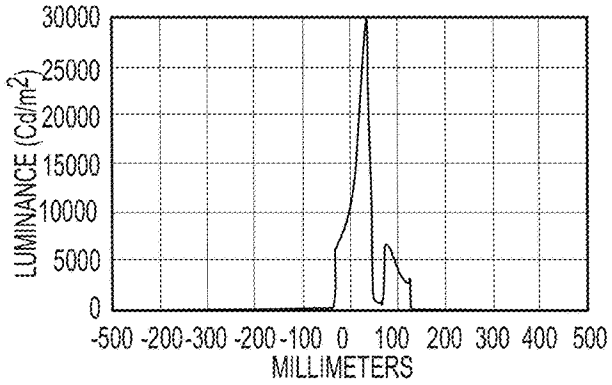

FIGS. 34A and 34B illustrate the luminance uniformity from a front view of a light fixture 100 using the sixth inner lens 140 at a full level. The front view is taken along the centerline C/L of the light fixture 100. In one example, the asymmetric lighting is a result of the environment in which the light fixture 100 is positioned and/or the housing 101 (e.g., polishing process of the housing 101). FIGS. 34C and 34D illustrate the luminance uniformity of a light fixture 100 with the sixth lens 140 at a full level from a 45° angle relative to the centerline C/L.

The light fixture 100 can be utilized for a circadian system that may be affected by lighting characteristics. Spectra and output lumens can be tuned or dynamically controllable according to a metric for proper circadian requirements (referred to as Circadian Stimulus). Factors for the circadian lighting are lumen level, spectrum (color), exposure timing, exposure duration, and distribution.

The light fixture 100 generates a wider distribution than a typical troffer-style light due to the inner lens 140. The wider distribution is desirable for the circadian system over time and duration.

The lighting fixture 100 can adjust the lumen levels using program instructions stored in control circuitry, such as remote circuitry or circuitry located within the control box 190. Color temperature of the light can vary between about 2700K to 6500K. The color temperature can be continuously tunable and dynamically controllable for proper CCTs. In one example, the LED elements 133 are tunable in CCT, such as those currently available from Nichia Corporation. In another example, the different LED elements 133 are assembled in a manner to make color variations.

Figure 21:
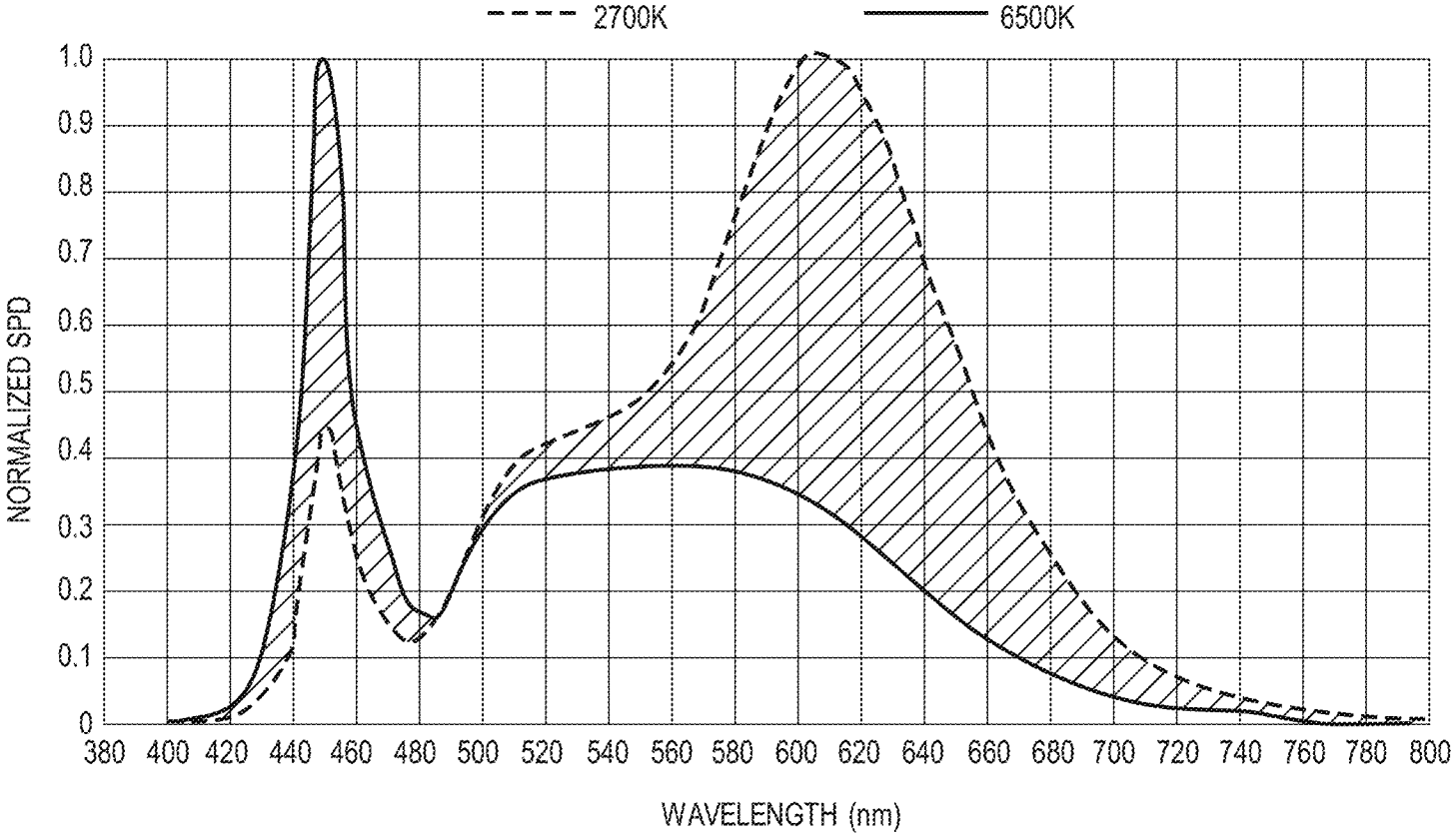
FIG. 21 is a graph of examples of spectra of tunable LED elements at 2700K and 6500K.

FIG. 21 illustrates examples of spectra of tunable LED elements 133 at two extreme CCTs, namely 2700K and 6500K. In one example, the spectrum is tuned continuously from 2700K to 6500K and operated dynamically depending on the condition of the circadian system. In another example, the spectrum is tuned between the two CCTs.

FIGS. 22A, 22B and 23A, 23B illustrate color rendering and distribution of a light fixture 100 at two extreme CCTs. In these examples, the light fixture 100 includes the fourth inner lens 140 (see FIGS. 14, 14A).

Figure 22A:
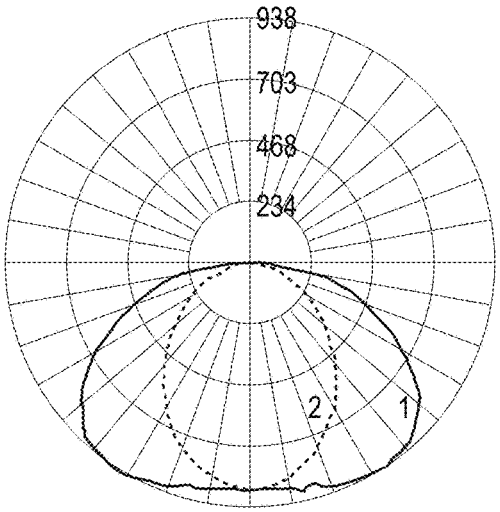
FIG. 22A is an exemplary representation of a simulated candela plot achieved with the fourth inner lens as in FIG. 14 over the spectrum at CCT 2700K with first and second plots with the first plot illustrating the intensity in a plane perpendicular to the longitudinal axis and the second plot in a plane along the longitudinal axis.
Figure 22B:
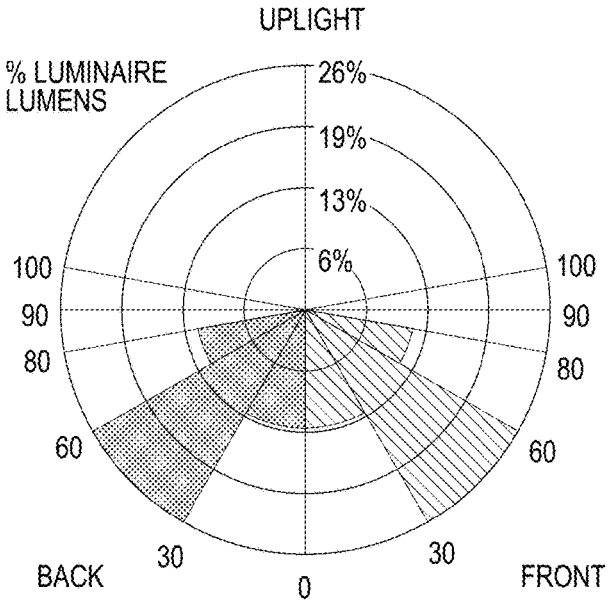
FIG. 22B illustrates luminous flux distribution patterns for a light fixture with a fourth inner lens as in FIG. 14 over the spectrum at CCT 2700K.

FIGS. 22A and 22B illustrate the light fixture 100 with a CCT at 2700K and 3000 Lm. The circadian distribution is wide. FIG. 22A illustrates the first plot 1 at 90° and the second plot 2 at 0°. FIG. 22B illustrates the luminous flux distribution with the following characteristics: FL=12.3%; FM=25.7%; FH=11.0%; FVH=0.9%; BL=12.3%; BM=25.7%; BH=11.0%; BVH=0.9%; UL=0.0%; and UH=0.0%.

Figure 23A:
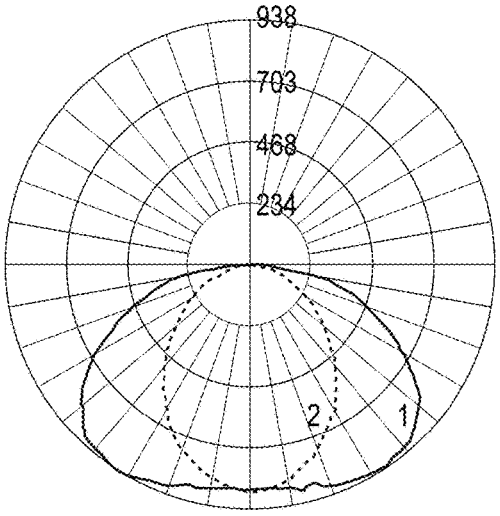
FIG. 23A is an exemplary representation of a simulated candela plot achieved with the fourth inner lens as in FIG. 14 over the spectrum at 6500K with first and second plots with the first plot illustrating the intensity in a plane perpendicular to the longitudinal axis and the second plot in a plane along the longitudinal axis.
Figure 23B:
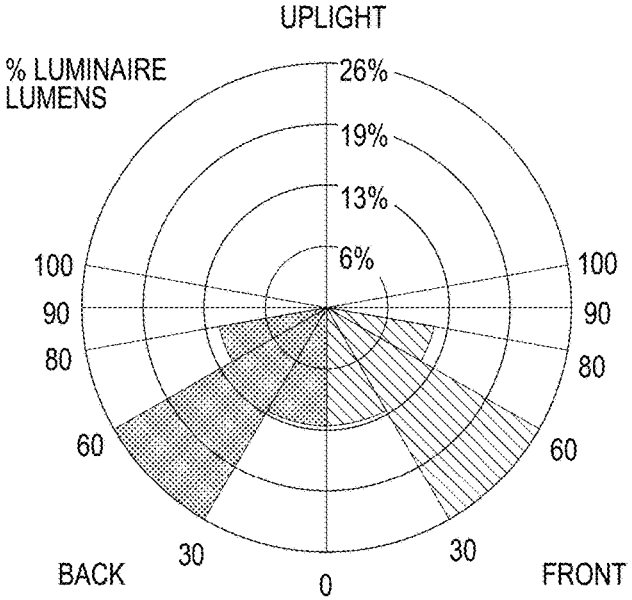
FIG. 23B illustrates luminous flux distribution patterns for a light fixture with a fourth inner lens as in FIG. 14 over the spectrum at CCT 6500K.

FIGS. 23A and 23B illustrate the light fixture 100 with a CCT at 6500K and 3000 Lm. The circadian distribution is wide. FIG. 23A illustrates the first plot 1 at 90° and the second plot 2 at 0°. FIG. 23B illustrates the luminous flux distribution with the following characteristics: FL=12.3%; FM=25.7%; FH=11.0%; FVH=0.9%; BL=12.3%; BM=25.7%; BH=11.0%; BVH=0.9%; UL=0.0%; and UH=0.0%.

Figures 24A, 24B:
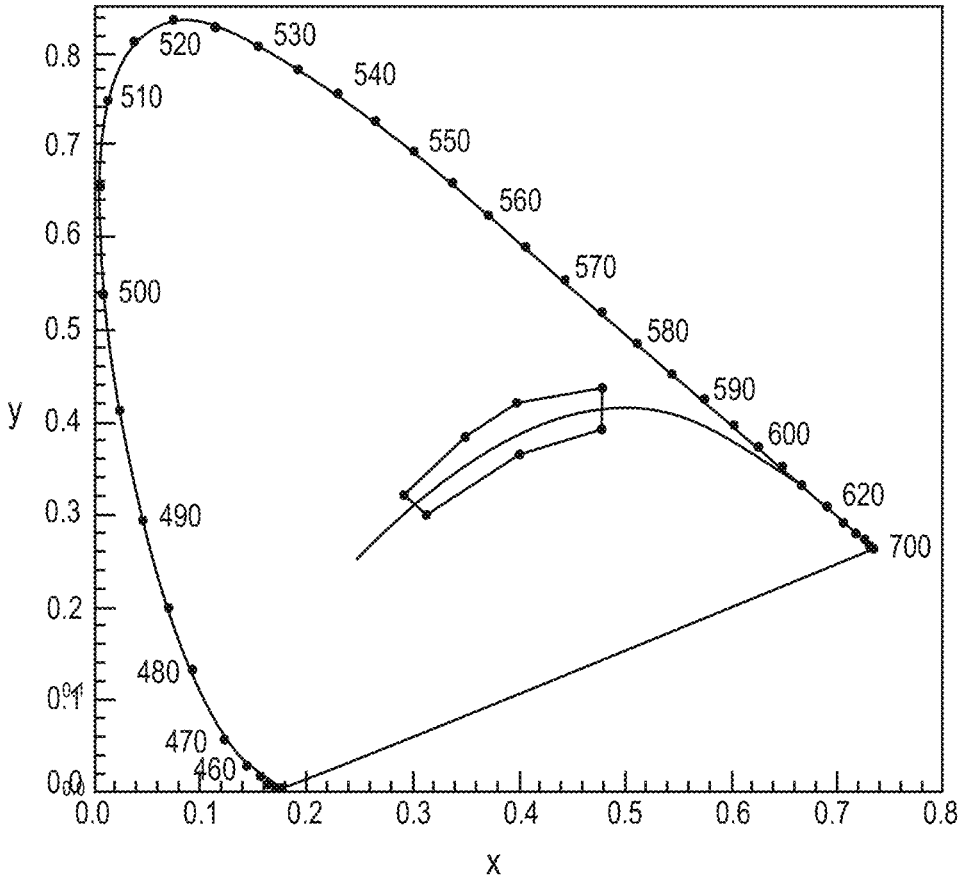
FIG. 24A is a diagram of the color space of a light fixture.
FIG. 24B are the data points for the color space of FIG. 24A.

As shown in FIG. 24A and listed in the table of FIG. 24B, the color space is defined by the following x, y coordinates on the 1931 CIE Chromaticity Diagram: (0.29, 0.32), (0.35, 0.38), (0.40, 0.42), (0.48, 0.44), (0.48, 0.39), (0.40, 0.36), (0.32, 0.30), (0.29, 0.32). The light fixture 100 can be operated at one or more color points within the color space depending on the requirement of the circadian system over time. In one example, lumen levels and duration may be dynamically operated to get circadian conditions in lighting.

The color of visible light emitted by a light source, and/or the color of a mixture visible light emitted by a plurality of light sources can be represented on either the 1931 CIE (Commission International de l'Eclairage) Chromaticity Diagram or the 1976 CIE Chromaticity Diagram. Persons of skill in the art are familiar with these diagrams, and these diagrams are readily available.

The CIE Chromaticity Diagrams map out the human color perception in terms of two CIE parameters, namely, x (or ccx) and y (or ccy) (in the case of the 1931 diagram) or u' and v' (in the case of the 1976 diagram). Each color point on the respective diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a color point that can be characterized with x, y coordinates on the 1931 CIE Chromaticity Diagram or with u', v' coordinates on the 1976 CIE Chromaticity Diagram.

In the 1931 CIE Chromaticity Diagram, deviation from a color point on the diagram can be expressed either in terms of the x, y coordinates or, alternatively, in order to give an indication as to the extent of the perceived difference in color, in terms of MacAdam ellipses (or plural-step Mac- Adam ellipses). For example, a locus of color points defined as being ten MacAdam ellipses (also known as "a ten-step MacAdam ellipse) from a specified hue defined by a particular set of coordinates on the 1931 CIE Chromaticity Diagram consists of hues that would each be perceived as differing from the specified hue to a common extent (and likewise for loci of points defined as being spaced from a particular hue by other quantities of MacAdam ellipses).

A typical human eye is able to differentiate between hues that are spaced from each other by more than seven MacAdam ellipses (and is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=(Δu'2+Δv'2)1/2. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus correspond to spectral power distributions that obey Planck's equation: $E(\lambda)=a/\lambda^{(5)}.(1/e^{(B/(\lambda.T))}-1)$, where E is the emission intensity, λ is the emission wavelength, T is the temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally bluish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

In one example, the light fixture 100 is designed to be a direct view troffer style with a large luminous source, a shallow depth, and color changing capability. In one example, the light fixture 100 can also include optical control. The direct view troffer style with the LED elements 133 on the back of housing 101 and aimed directly at the inner lens 140 provides for a more economical design that uses the housing 101 as a heat sink and overall includes fewer parts. The large luminous source provides for an increase in optic source size which for constant Lumen output and optical distribution yields a reduction in luminous intensity or glare reduction. Color changing provides for CCT and circadian control.

In light fixture design, it has been determined that the shorter the optical path length and the larger the source size, the harder it is to color mix the LEDs as well as limiting lens luminance uniformity. The more diffusion provides for color mixing and improved uniformity, but with lower optical efficiency. As disclosed in the tested data above in the luminance images, polar candela plots, and zonal distribution, the light fixtures 100 provide for good uniformity, optical control, and glare control while working with the constraints of troffer style designs listed above.

Figure 25:
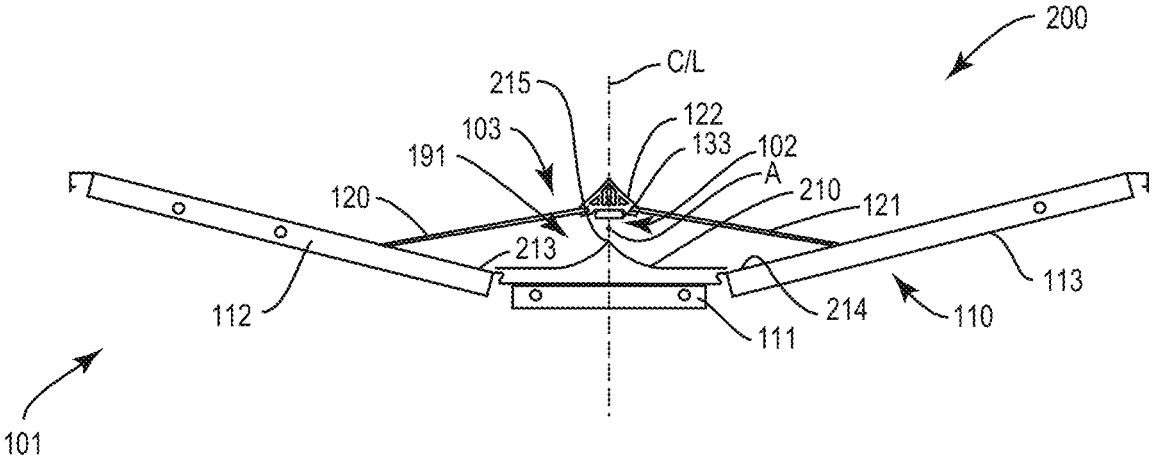
FIG. 25 is a side schematic view of a housing, LED assembly, reflector, and lens assembly of a light fixture.

FIG. 25 includes a light fixture 200 with an indirect troffer configuration. The light fixture 200 comprises a housing 101, LED assembly 102, and lens assembly 103 as disclosed above. The light fixture 200 further includes a reflector 210 positioned over the LED elements 133 to reflect the light. The light fixture 200 does not include an inner lens 140.

The light fixture 200 includes a longitudinal axis A and a centerline C/L. The light fixture 200 may be provided in many sizes, including standard troffer fixture sizes. However, it is understood that the elements of the light fixture 200 may have different dimensions and can be customized to fit most any desired fixture dimension.

The housing 101 and lens assembly 103 form an interior space 191 that houses the LED assembly 102 and the reflector 210. The LED assembly 102 includes various examples of LED elements 133 in an elongated manner that extends along the back pan 110. The LED assembly 102 is mounted to the connector 122 with the connector 122 also acting as a heatsink. The LED elements 133 face towards and illuminate the reflector 210. The light from the LED elements 133 is reflected from the reflector 210 to the fixture lens 120, 121 through which it is emitted into the environment. This arrangement is referred to as an "indirect troffer" design. The reflector 210 is configured with a hybrid configuration that provides for specular reflection in a central portion of the reflector 210 and diffuse reflection in the lateral portions of the reflector 210. This configuration provides for improved uniformity luminance. In one example, the LED assembly 102 is aligned with the longitudinal axis A of the light fixture 100.

Figure 26:
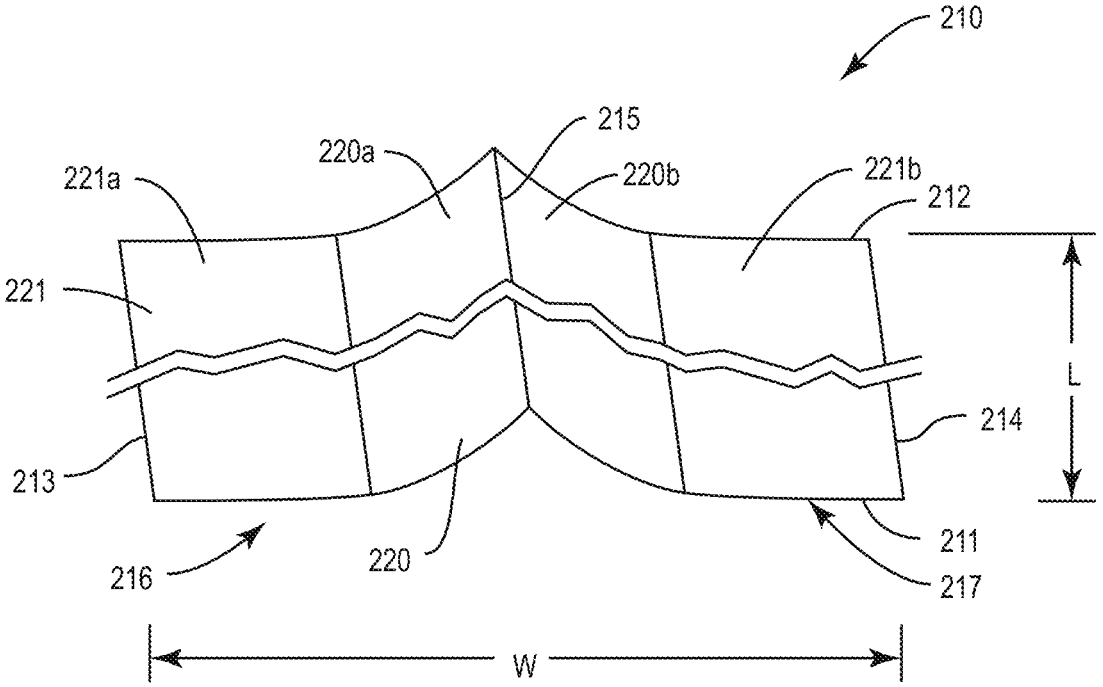
FIG. 26 is a schematic perspective view of a reflector.

The reflector 210 is positioned in the interior space 191 and faces towards the LED assembly 102 that is mounted on the connector 122. As illustrated in FIG. 26, the reflector 210 includes opposing ends 211, 212 that define a length L and opposing sides 213, 214 that define the width W. The length L is sized to extend along the length of the back pan 110. In one example, the ends 211, 212 abut against the end caps 115 of the housing 101. In another example, one or both ends 211, 212 are spaced away from the respective end caps 115. The width W is sized for the sides 213, 214 to contact against the back pan 110. As illustrated in FIG. 25, side 213 contacts against the first wing 112 and side 214 contacts against the second wing 113. The sides 213, 214 can be attached to the respective wings 112, 113, such as by one or more mechanical fasteners and adhesives.

The reflector 210 includes a peak 215 that extends the length L. The reflector 210 is aligned within the interior space 191 with the peak 215 positioned along the centerline C/L. The first lateral section 216 extends along the first side of the centerline C/L and the second lateral section 217 extends along the second side of the centerline C/L.

The reflector 210 includes a specular reflection section 220 along a central section and that extend the length L. The specular reflection section 220 includes sections **220*a*, 220*b* on opposing sides of the peak 215. The specular reflection sections 220*a*, 220*b* are positioned along the mid-portion of the reflector 210. The reflector 210 also includes a diffuse reflection section 221. The diffuse reflection section 221 includes diffuse sections 221*a*, 221*b* located along the outer lateral sections. Diffuse reflection section 221*a* extends between the specular reflection section 220*a* and the side 213, and diffuse reflection section 221*b* extends between the specular reflection section 220*b* and the side 214**.

In one example, in the boundary zones between the specular reflection section 220 and the diffuse reflection sections 221 can provide for a transition. For example, the boundary zones can include partially specular reflection section, e.g., 50/50 or 30/70 (specular/diffuse) so the lighting can be smoothly varying and give improved uniformity in luminance.

The reflector 210 illuminates both light zones 193, 194 symmetrically and provides for uniform luminance in both zones 193, 194. The mid-portion of the reflector 210 defined by the specular section 220 divides the light into two directions. The outer sections of the reflector 210 defined by the diffuse reflection sections 221*a*, 221*b* provides for diffuse reflection. Light from the specular reflection section 220 and directly from the LED assembly 102 is reflected diffusely to provide for uniform luminance.

The reflector 210 includes a symmetrical shape about the peak 215 with each of the lateral sections 216, 217 having the same shape and size. Further, the specular reflection sections 220*a*, 220*b* include the same shape and size, and the diffuse reflection sections 221*a*, 221*b* include the same shape and size.

In one example, the reflector 210 has a folded configuration. The fold line is formed at the peak 215. Each of the sections that extend between the peak 215 and the respective lateral side 213, 214 includes the same shape and size.

Figure 27A:
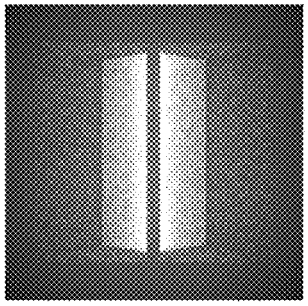
FIG. 27A is a front view along a centerline of a light fixture with a reflector illustrating luminance at the light fixture with a reflector that provides for entirely diffuse reflection.
Figure 27B:
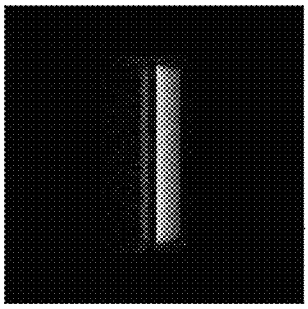
FIG. 27B is the light fixture of FIG. 27A at a 65° viewing angle.

FIGS. 27A, 27B, 27C, and 27D discloses an example of the light fixture 200 with a reflector 210 in which the entirety provides for diffuse reflection (i.e., the entire reflector 210 is a single diffuse reflection section 221). FIG. 27A illustrates the light fixture 200 view from the front along the centerline C/L (i.e., a 0° viewing angle). FIG. 27B illustrates the light fixture 200 at a 65° viewing angle). A light fixture with just a diffuse reflector 210 gives a hot luminance around the mid zone at the centerline C/L as the LED elements 133 give a strong intensity around the center zone 192.

Figure 27C:
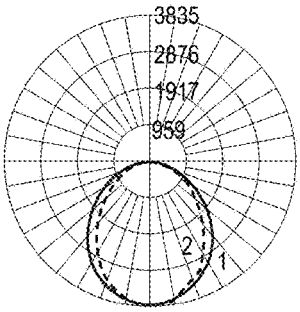
FIG. 27C is an exemplary representation of a simulated candela plot achieved with the light fixture of FIG. 27A with first and second plots with the first plot illustrating the intensity in a plane perpendicular to the longitudinal axis and the second plot in a plane along the longitudinal axis.
Figure 27D:
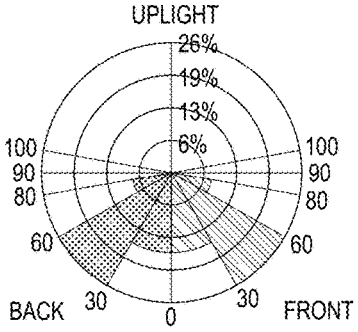
FIG. 27D illustrates luminous flux distribution patterns for the light fixture of FIG. 27A.

FIG. 27C illustrates intensity distribution with a Spacing Criterion (SC) of how much light can be distributed widely to make uniform at a given mounting height (i.e., it is the ratio of luminaires spacing to mounting height). The SC along the y-axis is 1.10, along the x-axis if 1.22, and along the diagonal is 1.28. FIG. 27D includes the following luminous flux distribution: FL=15.4%; FM=25.7%; FH=8.2%; FVH=0.6%; BL=15.4%; BM=25.8%; BH=8.3%; BVH=0.6%; UL=0.0%; and UH=0.0%.

Figure 28A:
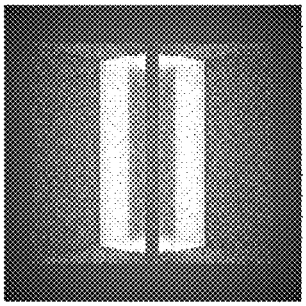
FIG. 28A is a front view along a centerline of a light fixture with a reflector illustrating luminance at the light fixture with a reflector that provides for entirely specular reflection.
Figure 28B:
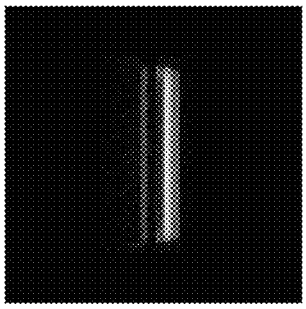
FIG. 28B is the light fixture of FIG. 28A at a 65° viewing angle.

FIGS. 28A, 28B, 28C, and 28D disclose an example of the light fixture 200 with a reflector 210 in which the entirety provides for specular reflection (i.e., the entire reflector 210 is a single specular reflection section 220). FIG. 28A illustrates the light fixture 200 view from the front along the centerline C/L (i.e., a 0° viewing angle). FIG. 28B illustrates the light fixture 200 at a 65° viewing angle). This light fixture 200 with just a specular reflector 210 gives a dim luminance around the mid zone at the centerline C/L as light is reflected towards both lateral sides strongly by the steep angle of the reflector 210 in proximity to the peak 215.

Figure 28C:
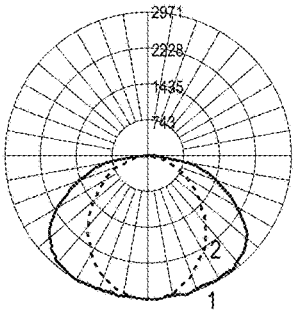
FIG. 28C is an exemplary representation of a simulated candela plot achieved with the light fixture of FIG. 28A with first and second plots with the first plot illustrating the intensity in a plane perpendicular to the longitudinal axis and the second plot in a plane along the longitudinal axis.
Figure 28D:
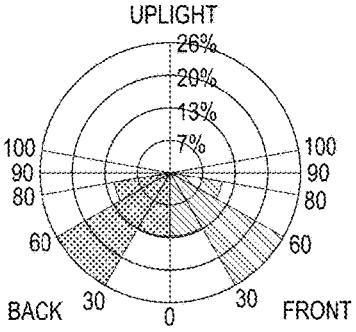
FIG. 28D illustrates luminous flux distribution patterns for the light fixture of FIG. 28A.

FIG. 28C illustrates intensity distribution with a SC along the y-axis is 1.16, along the x-axis if 1.54, and along the diagonal is 1.46. FIG. 28D includes the following luminous flux distribution: FL=12.5%; FM=26.0%; FH=10.6%; FVH=0.7%; BL=12.6%; BM=26.1%; BH=10.8%; BVH=0.7%; UL=0.0%; and UH=0.0%.

FIGS. 29A, 29B, 29C, 29D disclose a light fixture 210 with a hybrid reflector 210 as illustrated in FIG. 26 with both specular and diffuse reflection sections 220, 221. The combination of specular and diffuse reflection sections 220, 221 gives balanced luminance and good uniformity. Near the boundary where the specular and diffuse reflection sections 220, 221 meet, both reflection sections 220, 221 include some hot spots with higher luminance values than adjacent areas. In one example to reduce and/or eliminate the hot spots, the two reflection sections 220, 221 are mixed, such as by lightly diffusing the specular reflection section 221.

Figure 29A:
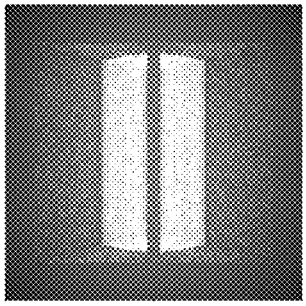
FIG. 29A is a front view along a centerline of a light fixture with a reflector illustrating luminance at the light fixture with a hybrid reflector with both specular and diffuse reflection sections.
Figure 29B:
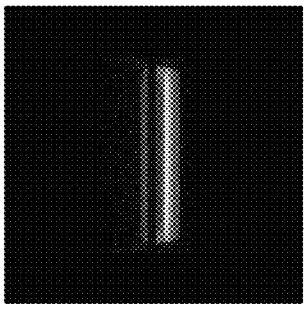
FIG. 29B is the light fixture of FIG. 29A at a 65° viewing angle.
Figure 29C:
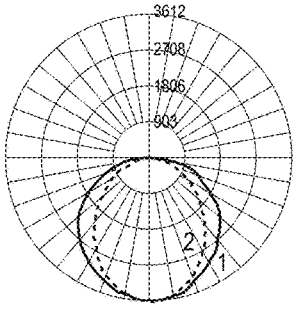
FIG. 29C is an exemplary representation of a simulated candela plot achieved with the light fixture of FIG. 29A with first and second plots with the first plot illustrating the intensity in a plane perpendicular to the longitudinal axis and the second plot in a plane along the longitudinal axis.
Figure 29D:
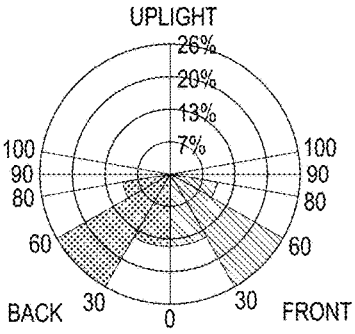
FIG. 29D illustrates luminous flux distribution patterns for the light fixture of FIG. 29A.

FIG. 29A illustrates the light fixture 200 view from the front along the centerline C/L (i.e., a 0° viewing angle). FIG. 29B illustrates the light fixture 200 at a 65° viewing angle). FIG. 29C illustrates intensity distribution with a SC along the y-axis is 1.12, along the x-axis if 1.28, and along the diagonal is 1.32. FIG. 29D includes the following luminous flux distribution: FL=14.4%; FM=25.6%; FH=9.3%; FVH=0.6%; BL=14.4%; BM=25.7%; BH=9.4%; BVH=0.6%; UL=0.0%; and UH=0.0%.

In the various examples, the light fixtures 100, 200 can include one or more communication components forming a part of the light control circuitry, such as an RF antenna that senses RF energy. The communication components may be included, for example, to allow the light fixture 100 to communicate with other light fixtures 100 and/or with an external wireless controller. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such a sensor may be integrated into the light control circuitry. In various embodiments described herein various smart technologies may be incorporated in the lamps as described in the following United States patent applications "Solid State Lighting Switches and Fixtures Providing Selectively Linked Dimming and Color Control and Methods of Operating," application Ser. No. 13/295,609, filed Nov. 14, 2011, now U.S. Pat. No. 8,736,186, which is incorporated by reference herein in its entirety; "Master/Slave Arrangement for Lighting Fixture Modules," application Ser. No. 13/782,096, filed Mar. 1, 2013, now U.S. Pat. No. 9,572,226, which is incorporated by reference herein in its entirety; "Lighting Fixture for Automated Grouping," application Ser. No. 13/782,022, filed Mar. 1, 2013, now U.S. Pat. No. 9,155,165, which is incorporated by reference herein in its entirety; "Lighting Fixture for Distributed Control," application Ser. No. 13/782,040, filed Mar. 1, 2013, now U.S. Pat. No. 8,975,827, which is incorporated by reference herein in its entirety; "Efficient Routing Tables for Lighting Networks," application Ser. No. 13/782,053, filed Mar. 1, 2013, now U.S. Pat. No. 9,155,166, which is incorporated by reference herein in its entirety; "Handheld Device for Communicating with Lighting Fixtures," application Ser. No. 13/782,068, filed Mar. 1, 2013, now U.S. Pat. No. 9,433,061, which is incorporated by reference herein in its entirety; "Auto Commissioning Lighting Fixture," application Ser. No. 13/782,078, filed Mar. 1, 2013, now U.S. Pat. No. 8,829,821, which is incorporated by reference herein in its entirety; "Commissioning for a Lighting Network," application Ser. No. 13/782,131, filed Mar. 1, 2013, now U.S. Pat. No. 8,912,735, which is incorporated by reference herein in its entirety; "Ambient Light Monitoring in a Lighting Fixture," application Ser. No. 13/838,398, filed Mar. 15, 2013, now U.S. Pat. No. 10,161,612, which is incorporated by reference herein in its entirety; "System, Devices and Methods for Controlling One or More Lights," application Ser. No. 14/052,336, filed Oct. 11, 2013, now U.S. Pat. No. 9,622,321, which is incorporated by reference herein in its entirety; and "Enhanced Network Lighting," Application No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

In various examples described herein various Circadian-rhythm related technologies may be incorporated in the light fixtures as described in the following: U.S. Pat. Nos. 8,310,143, 10,278,250, 10,412,809, 10,529,900, 10,465,869, 10,451,229, 9,900,957, and 10,502,374, each of which is incorporated by reference herein in its entirety.

The present invention may be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein. Although steps of various processes or methods described herein may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention.

What is claimed is:

1. A light fixture comprising:

a housing comprising a back pan, the housing comprising a centerline that bisects the housing into first and second lateral sections;

LED elements aligned in a linear array along the back pan;

a lens assembly that extends over the LED assembly, the lens assembly comprising a first fixture lens and a second fixture lens that are connected together along the centerline; and an inner lens that extends over the LED elements and is positioned on the centerline, the inner lens comprising a cavity that faces towards the LED elements and an outer surface that faces towards the lens assembly, the inner lens configured to direct light emitted from the LED assembly away from a center zone that is centered on the centerline and direct the light into first and second light zones positioned on each lateral side of the center zone and that extend between the center zone and the back pan.

2. The light fixture of claim 1, wherein the inner lens symmetrically divides the light equally with a first half of the light emitted into the first light zone and a second half of the light emitted into the second light zone.

3. The light fixture of claim 1, wherein the inner lens distributes the light smoothly from the outer surface without interaction.

4. The light fixture of claim 1, wherein the outer surface of the inner lens comprises a dimple that is aligned with the centerline, the outer surface further comprising a first section that extends between the dimple and a first lateral end and a second section that extends between the dimple and a second lateral end, each of the first and second sections comprising equal shapes and sizes.

5. The light fixture of claim 4, wherein the cavity comprises a peak that is aligned with the centerline and a shape that is symmetrical about the centerline.

6. The light fixture of claim 1, wherein the inner lens comprises a dimple on the outer surface and a peak on an inner surface of the cavity with each of the dimple and the peak positioned on the centerline, the inner lens comprising symmetrical first and second sections on opposing sides of a line that extends through the peak and the dimple.

7. The light fixture of claim 1, wherein the inner lens comprises a thickness measured between the cavity and the outer surface, the inner lens having a minimum thickness at a midpoint of a width measured between opposing lateral ends.

8. The light fixture of claim 1, wherein the light fixture comprises a lens uniformity of between about 1.5 and 2.0 in a front view.

9. The light fixture of claim 1, further comprising an enclosed interior space formed between the lens assembly and the back pan with the LED elements and the inner lens positioned in the interior space.

10. The light fixture of claim 1, wherein the lens assembly comprises a connector that connects together the first and second fixture lenses, the connector comprising a body with a first slot that receives an edge of the first fixture lens and a second slot that receives an edge of the second fixture lens, the connector aligned on the centerline.

11. The light fixture of claim 1, wherein the back pan comprises a concave shape with a center section that supports the LED assembly and a pair of wings that extends outward from the center section, the back pan having a symmetrical shape about the centerline that extends through the center section.

12. The light fixture of claim 1, wherein the light fixture comprises a lens uniformity of between about 2.0 and 4.0 in a front view.

13. A light fixture comprising:

a direct troffer unit comprising a longitudinal axis and a centerline that divides that direct troffer unit along the longitudinal axis into first and second lateral sections, the direct troffer unit comprising:

a back pan;

LED elements aligned in a linear array along the back pan;

a lens assembly that extends over the LED assembly; and an inner lens positioned between the LED elements and the lens assembly, the inner lens comprising:

a first surface that faces towards the LED elements and having a cavity that extends over the LED elements and comprises a peak that is positioned on the centerline;

an outer surface that faces towards the lens assembly and comprises a dimple that is positioned on the centerline.

14. The light fixture of claim 13, wherein the inner lens is symmetrical about a straight line that extends through both the peak and the dimple.

15. The light fixture of claim 13, wherein the outer surface comprising a first section that extends between a first lateral end and the dimple and a second section that extends between a second lateral end and the dimple, the first and second sections comprising equal shapes and sizes.

16. The light fixture of claim 13, wherein the cavity comprises a symmetrical shape about a straight line that extends through both the peak and the dimple.

17. The light fixture of claim 13, wherein the inner lens is configured to distribute light rays from the LED assembly smoothly without interaction.

18. The light fixture of claim 13, wherein the inner lens is a negative lens that diverges light from the LED assembly outward away from the centerline.

19. The light fixture of claim 13, wherein the inner lens is configured to divert light away from a center zone that is centered along the centerline and to direct light into first and second light zones positioned on lateral sides of the center zone.

20. A light fixture comprising:

a housing comprising a back pan, the housing comprising a centerline that bisects the housing into first and second lateral sections;

LED elements aligned in a linear array along the back pan;

a lens assembly that extends over the LED elements, the lens assembly comprising a first fixture lens and a second fixture lens that are connected together along the centerline; and a reflector that extends between the LED elements and the lens assembly, the reflector comprising a symmetrical shape that is centered on the centerline and comprising a central specular reflection section centered on the centerline and outer diffuse reflection sections on each lateral side of the specular section.

21. The light fixture of claim 20, wherein the reflector comprises a folded configuration with a fold line that is located along a center of the specular section and with the fold line being collinear with the centerline.

22. The light fixture of claim 20, wherein the reflector comprises partially diffuse reflection around the boundary of the central specular reflection section and the outer diffuser reflection section.

23. A light fixture comprising:

a housing comprising a back pan, the housing comprising a centerline that bisects the housing into first and second lateral sections;

first LED elements aligned in a first linear array along a first section of the back pan;

second LED elements aligned in a second linear array along a second section of the back pan with the second section spaced away from the first section; and a lens that extends over the first and second LED elements and is centered along the centerline, the inner lens comprising a cavity that faces towards the first and second LED elements and an outer surface that faces towards the first and second LED elements, the lens configured to direct light emitted from the first and second LED elements away from a center zone that is centered on the centerline and direct the light into first and second light zones positioned on each lateral side of the center zone and that extend between the center zone and the back pan.

24. The light fixture of claim 23, wherein the lens is symmetrical about the centerline and comprises a first reflector body on a first lateral side of the centerline and aligned over the first LED elements and a second reflector body on an opposing second lateral side of the centerline and aligned over the second LED elements, each of the first and second reflector bodies comprises an inner reflective surface that faces towards the centerline.

* * * * *